US011008074B2

(12) United States Patent
Robertson et al.

(10) Patent No.: US 11,008,074 B2
(45) Date of Patent: May 18, 2021

(54) PASSENGER VESSEL WITH RETRACTABLE, CONCEALABLE BOW GANGWAY AND METHOD FOR DEPLOYING, RETRACTING AND CONCEALING A PASSENGER VESSEL'S GANGWAY

(71) Applicant: Chesapeake Shipbuilding Corp, Salisbury, MD (US)

(72) Inventors: Charles A. Robertson, Vero Beach, FL (US); John E. Womack, Salisbury, MD (US)

(73) Assignee: CHESAPEAKE SHIPBUILDING CORP., Salisbury, MD (US)

( * ) Notice: Subject to any disclaimer, the term of this patent is extended or adjusted under 35 U.S.C. 154(b) by 0 days.

(21) Appl. No.: 16/698,445

(22) Filed: Nov. 27, 2019

(65) Prior Publication Data

US 2020/0172204 A1 Jun. 4, 2020

Related U.S. Application Data

(60) Provisional application No. 62/773,774, filed on Nov. 30, 2018.

(51) Int. Cl.

| | |
|---|---|
| ***B63B 27/00*** | (2006.01) |
| ***B63B 27/14*** | (2006.01) |
| ***B63B 19/08*** | (2006.01) |

(52) U.S. Cl.

CPC ..... *B63B 27/143* (2013.01); *B63B 19/08* (2013.01); *B63B 2019/083* (2013.01); *B63B 2027/141* (2013.01)

(58) Field of Classification Search

CPC ..... B63B 19/08; B63B 27/143; B63B 2027/141; B63B 2019/083; B64F 1/305

USPC ..... 14/69.5–71.5; 114/60, 362; 414/362

See application file for complete search history.

(56) References Cited

U.S. PATENT DOCUMENTS

| | | | | | |
|---|---|---|---|---|---|
| 3,280,777 | A * | 10/1966 | Matzer | B63B 19/08 | 114/70 |
| 3,468,280 | A * | 9/1969 | Williams | B63B 27/143 | 114/72 |
| 3,483,838 | A * | 12/1969 | Rath | B63H 25/42 | 114/60 |
| 3,879,784 | A * | 4/1975 | Kummerman | B63B 27/143 | 14/71.1 |
| 4,011,615 | A * | 3/1977 | Maxson | B63B 27/14 | 14/71.1 |
| 4,039,163 | A * | 8/1977 | Shorey | B64C 1/22 | 244/137.1 |

(Continued)

*Primary Examiner* — Raymond W Addie

(74) *Attorney, Agent, or Firm* — J. Andrew McKinney, Jr.

(57) ABSTRACT

A passenger vessel 10 configured to moor along an improved or unimproved shoreline to load or unload the vessel via the bow includes a hull 20 having a movable, openable bow member 24 configured to be moved between a closed state and an open state which exposes the hull's interior volume and an extendable and steerable ramp assembly 14 including an elongated extendable ramp member 78 configured to be stowed in the hull's interior when the bow member is in the closed state. The ramp member is extendable by being conveyed forwardly through the bow opening to define a distally projecting ramp extension supported and steerable (vertically and laterally) from a pivot or swing mount frame 84 affixed within the hull 20.

23 Claims, 16 Drawing Sheets

(56) References Cited

U.S. PATENT DOCUMENTS

| | | | | | |
|---|---|---|---|---|---|
| 4,235,399 | A * | 11/1980 | Shorey | B64C 1/22 | 14/71.1 |
| 4,500,299 | A * | 2/1985 | Kelley | A63H 27/00 | 446/230 |
| 5,462,002 | A * | 10/1995 | Wendt | B63B 3/46 | 114/260 |
| 8,006,337 | B2 * | 8/2011 | Birmingham | B63B 27/143 | 14/71.1 |
| 8,402,584 | B2 * | 3/2013 | Westermark | B63B 27/143 | 14/71.3 |
| 10,046,835 | B2 * | 8/2018 | Ryan | B63B 19/08 | |
| 10,486,775 | B2 * | 11/2019 | Nostvold | B63B 27/30 | |
| 2005/0081775 | A1 * | 4/2005 | Blank | B63B 27/143 | 114/362 |
| 2006/0005755 | A1 * | 1/2006 | Burg | B63B 1/38 | 114/67 A |
| 2006/0060128 | A1 * | 3/2006 | Bailey | B63B 27/143 | 114/362 |
| 2013/0283550 | A1 * | 10/2013 | Clarke | E01D 15/24 | 14/69.5 |
| 2014/0158038 | A1 * | 6/2014 | Johnston | B63B 1/06 | 114/355 |

* cited by examiner

PASSENGER VESSEL WITH RETRACTABLE, CONCEALABLE BOW GANGWAY AND METHOD FOR DEPLOYING, RETRACTING AND CONCEALING A PASSENGER VESSEL'S GANGWAY

PRIORITY CLAIM AND REFERENCE TO RELATED APPLICATIONS

This application claims priority to and benefit of U.S. Provisional Application No. 62/773,774, filed Nov. 30, 2018 by Charles A. ROBERTSON and John E. WOMACK and entitled "Passenger Vessel with Retractable, Concealable Bow Gangway and Method for Deploying, Retracting and Concealing a Passenger Vessel's Gangway" the disclosure of which is hereby incorporated herein by reference.

BACKGROUND OF THE INVENTION

Field of the Invention

The present invention relates, in general, to passenger vessels such as cruise ships and river boats which are usually configured to moor to an improved pier for normal embarking/disembarking, and more particularly to an improved retractable gangway located in the bow of such a vessel and movable for enabling embarking and disembarking at either improved or unimproved shore locations and to the method of employing such gangways.

Discussion of the Prior Art

Marine vessels such as cruise ships and river boats are designed for transporting passengers and are normally designed specifically for particular applications or types of voyages, such as for landing a small number of passengers or vehicles on unimproved shorelines, for facilitating mooring and embarking/disembarking at improved locations where piers or other docking facilities are available, and other well-known applications. In some situations, however, it is desirable to have a vessel that is more versatile so that it can be used for more than one purpose or type of voyage. Due to the specific nature of some uses, designing a vessel for multiple applications or different types of voyages or destinations can be problematic. For example, cruise ships and river boats for passengers are usually configured to moor alongside an improved pier for normal embarking/disembarking, but the use of such vessels is limited to locations having compatible facilities. As a result, such vessels cannot utilize desirable destinations that are not equipped with a suitable pier.

However, in some applications it is desirable to transport cruise ship or river boat pleasure cruise passengers to a destination having an unimproved shoreline or to a location that is difficult to access, such as a narrow slip of land. Shipbuilder Luther H. Blount's company, Blount Marine Corporation, has made and sailed a small Cruise Ship named the "Grand Mariner" which included a "Blount Bow Ramp" for use on such cruises (as shown in the archival "prior art" photograph of FIG. 1). The Blount Bow Ramp descends from the vessel hull's bow in a straight line aligned with the centerline of the hull, which means the vessel must be moored perpendicular to the shoreline which could interfere with passing traffic or could be difficult or impossible due to in-river currents. The Blount bow ramp cannot be swung left or right independently of moving the entire vessel, so the ramp's distal or landward end must be steered by moving the entire vessel.

Other vessel designs are not as suitable for use in passenger vessels; for example, so-called "Ro-Ro" Passenger/Cargo Ship Bow Ramps, require an improved dedicated shore side facility and so are unsuitable for use when passengers want to disembark onto any un-improved shoreline that the vessel can moor alongside. Mooring alongside the shoreline, to the extent possible, is desirable when the moored vessel might otherwise interfere with passing traffic and mooring perpendicularly to an unimproved shoreline might be difficult or impossible due to in-river currents.

Earlier prior art includes so called landing craft, which are well known and have been used extensively through history for carrying small numbers of people and vehicles for deploying on land. Various systems of ramps and/or doors have been employed in such vessels for allowing ingress and egress, and many such vessels have been used for military applications deploying people and equipment on land. However, landing craft style bow ramps usually are visible at all times when not in use and are not aesthetically pleasing for passenger style cruise ships.

There is a need, therefore, for a passenger vessel embarking/debarking system design and method that will allow such vessels to either (a) moor along an unimproved shoreline and transfer passengers, crew, stores and other items between the ship and the shore or (b) be used at an improved dock side facility where it is desired to load or unload the vessel via the bow without interfering with the aesthetically pleasing hull designs that as are desirable for cruise ships and river boats.

OBJECTS AND SUMMARY OF THE INVENTION

Accordingly, it is a primary object of the present invention to overcome the above mentioned difficulties by providing a versatile passenger vessel design and method of docking that enables a passenger vessel to moor along either an unimproved shoreline or along an improved dock facility to transfer passengers, crew, stores and other items between the ship and the shore, where it is desired to load or unload the vessel via the bow.

Another object of the present invention is to provide improvements to passenger vessels such as river boats or cruise ships, which usually include aesthetically pleasing hull designs and which are usually configured to moor alongside an improved pier, to enable such vessels to be moored at improved or unimproved shore locations and to allow normal embarking and disembarking by way of a gangway located at the vessel's bow.

Still another object of the present invention is to provide a passenger vessel configuration and method which may, in use, either (a) moor along an unimproved shoreline and transfer passengers, crew, stores and other items between the ship and the shore or (b) be used at an improved dock side facility where it is desired to load or unload the vessel via the bow.

The aforesaid objects are achieved individually and in combination, and it is not intended that the present invention be construed as requiring two or more of the objects to be combined.

In brief, the passenger vessel of the invention incorporates a unique and novel retractable, concealable bow gangway and utilizes a method for deploying, retracting, storing and concealing the gangway. With the vessel hull and concealable gangway or ramp of the present invention, when an improved pier is not available, or when the moorings are insufficient to properly moor side-to, the concealable, steerable bow ramp of the present invention is employed. In accordance with this aspect of the invention, a vessel hull incorporates a movable bow member configured to be moved between a normal closed state and an open state which exposes the vessel hull's interior and reveals an extendable and steerable ramp or gang-plank assembly. This assembly includes an elongated extendable ramp or gang-plank member configured to be retracted and stowed in the hull's interior when the bow member is in the closed state. When the ramp is retracted, its proximal end is in a stowed position which is (a) proximate either the hull's port side or starboard side, or (b) along or near the hull's centerline, as required by or best fits a particular vessel's deck layout. The ramp member is extendable by being conveyed distally, or forwardly, through the bow opening and is operable to extend the ramp distally beyond the bow to define a distally projecting ramp extension supported and steerable from a pivot or swing mount affixed within the hull. The ramp assembly includes a mounting frame (or a rotate and pivot mount) which is rotatable around a vertical axis to swing the ramp member's distal end from side to side and is pivotable around a horizontal pivot axis so that the ramp member's distal end can pivot vertically (raised or lowered) about the horizontal axis. The ramp member's distal end is steered vertically or horizontally as needed after it has been extended to project distally or forwardly beyond the bow. The ramp or gangplank, when deployed from the hull can be steered or rotated to swing in, for example, a 55 degree arc to port or starboard from a hull centerline and can also be steered or pivoted down to a selected down angle (e.g. 7 degrees) or up to a selected up angle (e.g., 17 degrees) from a horizontal plane formed, for example, by the surface of the main deck plate or passenger access deck. The available side to side and available down and up angles may be selected for particular vessel configurations and uses. The ramp angle horizontally with respect to the centerline of the hull and vertically with respect to the selected horizontal plane is controlled by the ship's crew from the rotate and pivot mount when the ramp is extended.

The advantages of the concealable gangplank or bow ramp system and method of the present invention include;

1) The vessel can moor at any unimproved shoreline that the vessel can moor alongside and have a safe and efficient method of moving passengers, crew, stores, etc. between the ship and shoreline.

2) The bow ramp can also be used at an improved dock side facility where it is desired to load or unload the vessel via the bow.

3) The vessel can moor parallel or nearly parallel to the shoreline to minimize the effects of any currents on the vessel.

4) The vessel can moor parallel or nearly parallel to the shoreline to minimize the intrusion of the vessel into any channels or navigation waterways along the shoreline.

5) The bow ramp can be deployed to either side of the vessel to allow the vessel to moor into the current regardless of which shoreline they are mooring to.

6) The bow ramp can be retracted into the vessel's bow for protection of the ramp when the ramp is not in use;

7) The bow ramp can be retracted into the vessel's bow to conceal it when not in use to allow for exterior visual appearance considerations; and 8) The closed bow door mechanism provides a sealed, smooth exterior hull surface which provides enhanced seaworthiness.

The extendable concealable ramp assembly is preferably configured as a unitary support structure or a single piece that slides inside a stationary yoke. In an alternative embodiment, the ramp assembly may be two aligned sliding ramp members configured to distally extend and slide out of the yoke.

When in use, to retract and stow the ramp, the forward or distal end must be aimed for retraction along its normal resting axis which may, in one exemplary embodiment, be along the hull's interior surface on the port or starboard side. If the design calls for the ramp member to be stowed along the inside of the starboard side of the hull, the ramp would be pivoted to the selected retraction aiming angle (e.g., from zero to 22 degrees to starboard from the hull center line) and would be steered or rotated vertically until parallel to the main deck. In this case the ramp is not aligned with the centerline of the vessel, but with the starboard side of the hull. As noted above, the retracted ramp assembly may be stowed, proximate the hull's port side or starboard side, or near the hull's centerline, as required for a particular vessel's deck layout or vessel design.

In the preferred form of the invention illustrated herein, the retractable bow ramp of the present invention consists of two primary assemblies, the opening bow assembly of the vessel and the retractable bow ramp itself which may be used to carry out the method of the invention as follows:

A. Opening Bow Assembly—This part of the invention involves making a portion of the vessels bow movable to allow for deployment of the retractable bow ramp assembly. The movable portion of the bow can be of one or more sections, hinged or sliding, as required to suit the bow configuration of the vessel being fitted with the retractable bow ramp.

B. Retractable Bow Ramp Assembly—This part of the invention consists of a movable ramp that is mounted in a trunnion assembly affixed to the deck within the bow of the vessel. The movable ramp can consist of a single section or a multiple section assembly that extends as required to span the distance between the vessel and the shore and retracts to fit within the allotted storage space. The trunnion assembly consists of mounting framework which serves four functions: securing the ramp within the bow of the vessel; extending and retracting the ramp; swinging the extended ramp left or right; and raising or lowering the outboard or distal end of the ramp.

C. Retractable Bow Ramp Operation—The method of the present invention works in a three-step process after the vessel has been moored alongside a shoreline, either with or without any improved shore side docking facilities. Once moored, the vessel's movable bow section is opened, then the bow ramp is extended distally or forwardly from its concealed storage space within the bow. Lastly the bow ramp is rotated horizontally (or slewed) either left or right and pivoted vertically up or down to land the bow ramp's distal or outboard end ashore. Retraction of the bow ramp after use is the reverse of the steps used to deploy the bow ramp, once the ramp has been steered into the selected retraction aiming angle.

The concealed retractable bow ramp of the invention enables the movement of passengers, crew, stores, and other items between the ship and the shore where shore access is only available at unimproved locations via the bow of the vessel and to be hidden from view when not in use for visual appearance considerations.

The bow of the vessel of the present invention is designed to open, allowing a retractable rotating gangway to extend from the ship's main deck or passenger access deck directly to a riverbank or dock. The bow, once opened, provides lateral clearance permitting the rotating gangway or ramp to nimbly rotate or pivot laterally so that the gangway gives the ship the ability to make "bow landings" wherever needed. This feature gives the vessel of the present invention an array of options for passenger itineraries and pleasure cruise destinations.

In summary, then, the present invention provides a passenger vessel concealable gangplank assembly which includes an elongated extendable ramp or gang-plank member having a ramp distal end opposite a ramp proximal end and being configured with a steerable mount fastened within a passenger vessel hull interior below a hull upper deck. The elongated extendable ramp or gang-plank member is configured to be stowed in a nondeployed state with the ramp distal end near a forward section of the hull of the passenger vessel and within an openable bow member in its closed state. The ramp proximal end is configured to be in a stowed position adjacent a port hull segment or a starboard hull segment when the gang-plank member is in a nondeployed state. The passenger vessel includes a bow member movable to an open state to provide a bow opening, and the ramp member is extendable by being conveyed distally or forwardly through the bow opening from the stowed position to an extended position.

The gangplank assembly steerable mount includes a pivot or swing mounting frame affixed within said hull interior volume to support the ramp, the extendable and steerable ramp or gang-plank assembly being operable to extend the elongate ramp member's distal end distally beyond the vessel bow to define a deployed state in which a distally projecting ramp extension is supported from the ramp's proximal end. The gangplank assembly further includes a drive mechanism for the extendable and steerable ramp or gang-plank assembly that is operable to steer the elongate ramp member's distal end vertically and laterally in arcs defined beyond the vessel bow, including a lateral ramp steering arc angle to either the port or starboard side and a vertical ramp steering angle, wherein said ramp angles extend from a centerline plane and are controlled from the pivot or swing mounting frame when the ramp member is extended and is in the deployed state. The passenger vessel concealable gangplank assembly includes a steering mechanism to steer said elongate ramp member's distal end laterally in an arc defined beyond the bow through a ramp steering arc angle of up to 90 degrees from the vessel's centerline to either the port or starboard side of said vessel's hull.

In one embodiment of the invention, the extendable and steerable ramp or gang-plank assembly comprises a unitary or one-piece elongated extendable ramp or gang-plank member defining a single rigidly supported span from the ramp distal end to the ramp proximal end, wherein the ramp member is extended by being conveyed distally through the bow opening from its stowed position to its extended, deployed position. Alternatively, the extendable and steerable ramp or gang-plank assembly comprises a two-piece telescoping ramp assembly including first and second slidably engaged telescoping ramp members defining a two-piece supported span from the telescoped ramp distal end to the opposing ramp proximal end, wherein said two-piece telescoping ramp assembly is telescoped and extended by being conveyed distally along a ramp axis through the bow opening from its stowed position to its telescoped extended deployed position.

The extendable and steerable ramp or gang-plank assembly pivot or swing mount affixed within the hull interior volume preferably comprises a mounting frame to support the ramp, the mounting frame including a support structure which incorporates a bottom, or base cross-member spanning a lateral width of the frame support structure, port and starboard, or left and right parallel upright or vertical members or posts extending the height of the frame, and a top cross-member which spans the lateral width of the frame between the vertical members. Slide supports are mounted inside the mounting frame on the vertical frame members, each slide support being secured by a horizontal pivot axle to a corresponding frame member and centered on a horizontal pivot axis for pivotal motion with respect to the vertical frame member, the slide supports receiving and movably securing the ramp within and extending through the mounting frame to enable the ramp to slide forwardly and rearwardly through the frame for extension forwardly out of the hull and rearwardly into the hull for storage. The extendable and steerable ramp or gang-plank assembly mounting frame further includes a drive mechanism connected between the mounting frame and at least one of slide supports to pivot the ramp about the horizontal axis. The extendable and steerable ramp or gang-plank assembly mounting frame is preferably pivotably mounted between the upper and intermediate decks by vertically extending pivot pins mounted on the bottom and top crossmembers of the mounting frame. The drive mechanism employed to laterally slew (or rotate the frame about the vertical axis) from port to starboard includes a slew frame sprocket driven by a hydraulic motor tensioned chain. Alternatively, an electric motor could be used in the slew frame mechanism.

The present invention thus provides a method for operating a passenger vessel to embark or disembark passengers and crew or to load and unload stores or other items by way of a bow access opening when moored along either an improved or unimproved shoreline. Briefly, the method comprises the steps of providing a vessel having a hull with a movable bow member configured to be moved between a normal closed state and an open state which exposes an interior volume of the hull and providing an extendable and steerable ramp or gang-plank assembly including an elongated retractable and extendable ramp or gang-plank member. The method further includes stowing the assembly in its retracted state within the interior volume of the hull when the bow member is in the closed state and, when retracted, locating a proximal end of the ramp in a stowage location on a vessel deck and locating a distal end of the ramp within the closed bow member. After mooring the vessel adjacent an improved or unimproved shoreline, the method includes opening the bow member to expose the ramp assembly, extending the ramp through the bow opening forwardly of the hull, and steering the distal end of the ramp to contact and rest on the adjacent shoreline. Before the vessel departs from the mooring, the method of the invention includes steering the ramp to remove it from contact with the adjacent shoreline, rotating the distal end of the ramp horizontally to a predetermined beginning position in alignment with its prior stowed location in the hull, pivoting the distal end of the ramp to raise or lower it vertically until the ramp is parallel to the storage deck, stowing the ramp within the hull by retracting the ramp into its stowage location, and closing the bow member to conceal the ramp.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
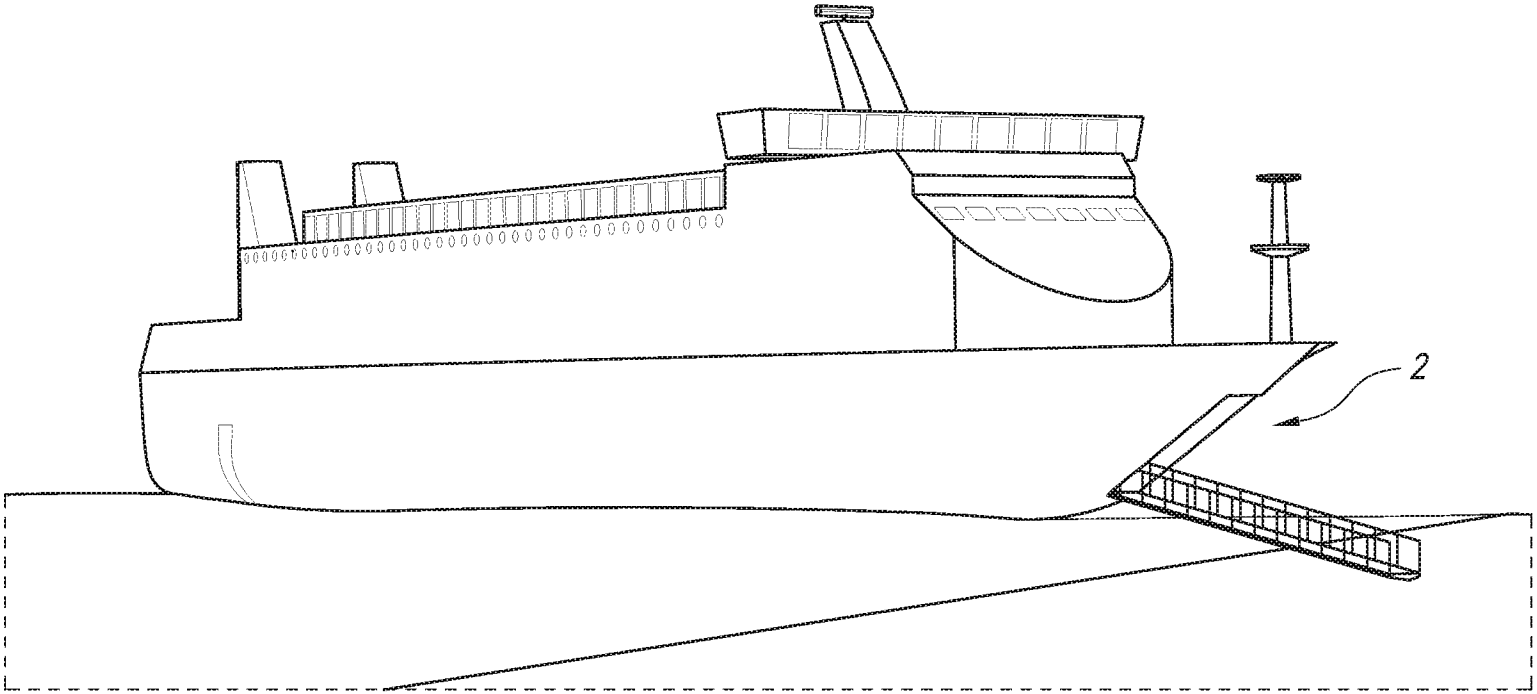
(PRIOR ART) FIG. 1
FIG. 1 is an archival photo of a passenger vessel featuring the "Blount Bow Ramp", in accordance with the prior art.

As discussed above, the use of a forward-extending ramp for a passenger vessel is known in the prior art, as generally illustrated at 2 in FIG. 1. Such a ramp, which may be referred to as a "Blount-Style Bow Ramp" is located in the hull of the vessel and descends from the vessel hull's bow in a straight line. As illustrated, the ramp is pivotally mounted at its bottom end at the bottom of a hull opening and when deployed its upper end pivots outwardly and downwardly to engage an unimproved shoreline. The deployed ramp is aligned with the centerline of the hull, which means the vessel must be moored generally perpendicular to the shoreline which can be a problem in many cases, as where the vessel could interfere with passing traffic or where could be difficult or impossible to safely moor due to in-river currents. Further, since the Blount bow ramp cannot be swung left or right independently of the hull, the ramp's distal or landward end must be steered by moving the entire vessel.

The present invention, as herein described with respect to a preferred embodiment, overcomes the above mentioned difficulties by providing a versatile passenger vessel design and method of docking that enables a passenger vessel 10 to moor along either an unimproved shoreline or along an improved dock facility to transfer passengers, crew, stores and other items between the ship and the shore, where it is desired to load or unload the vessel via the bow. The invention incorporates an extendable ramp that is mounted in a trunnion assembly affixed to the deck within the bow of the vessel. The movable ramp can consist of a single section or a multiple section assembly that extends as required to span the distance between the vessel and the shore and retracts to fit within an allotted storage space. The trunnion assembly consists of a mounting framework which serves four functions: securing the ramp within the bow of the vessel; extending and retracting the ramp; swinging the extended ramp left or right; and raising or lowering the outboard or distal end of the ramp. This arrangement allows the vessel to be moored along a shoreline and when deploying the ramp to swing the ramp laterally and to raise or lower it to engage the shore without the necessity of moving the vessel to orient the ramp, and without requiring the vessel to interfere with passing traffic.

Turning now to a more detailed description of a preferred form of the invention, there is illustrated in FIGS. 2-7 a forward portion of a passenger vessel 10 similar to those conventionally used in inland waterways 12 and configured to be moored in the usual way to an improved pier for normal embarking and disembarking. Such mooring capabilities, being conventional, are not here shown. In accordance with the present invention, the vessel 10 incorporates a concealable, steerable bow ramp assembly generally indicated at 14 which may be deployed when an improved pier is not available, such as when the pier moorings are insufficient to properly moor side-to, or when it is desired to moor the vessel along an unimproved shoreline 16. For purposes of nomenclature, the passenger vessel 10 includes a conventional hull 20 having a forward section 22 including the bow and a rearward stern section (not shown) separated by a hull length defined along a hull centerline, where the hull 20 includes a port side hull segment and a starboard side hull segment which curve downwardly and inwardly to join at a keel to define a hull bottom. The port hull segment and the starboard hull segment are each joined at their upper edges to a generally planar horizontal upper deck so that the port hull segment, the starboard hull segment and the upper deck define an enclosed hull interior volume therebetween. Vessel hull 20 also includes at least one generally planar horizontal intermediate deck defined within the hull interior volume between the upper deck and the hull bottom. As diagrammatically illustrated in various Figures, such as FIGS. 4, 5, 8 and 9, the vessel incorporates typical passenger and operational facilities which are not here described as they are conventional matters of ship design.

Figure 2:
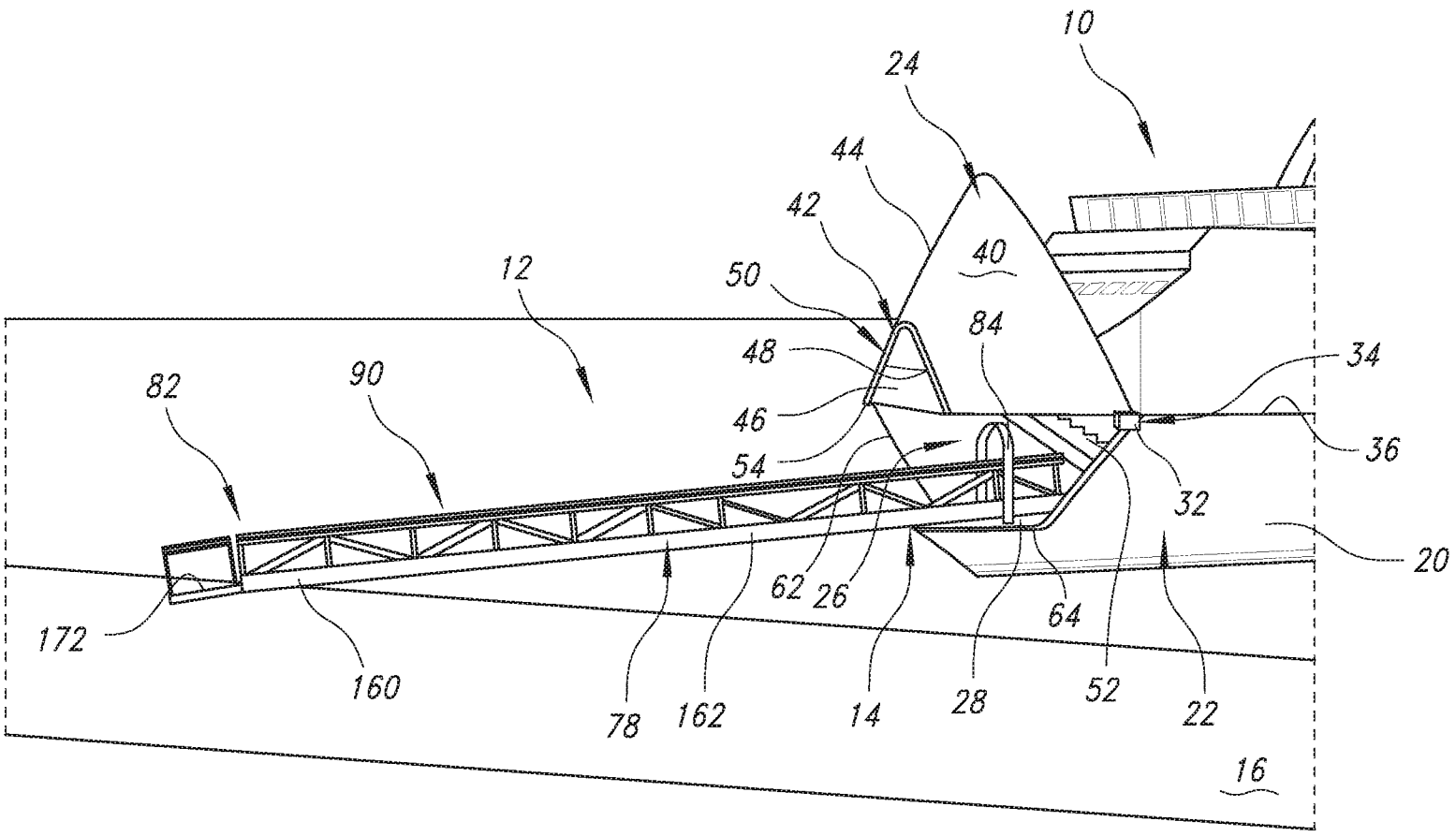
FIG. 2 is a front perspective view of the forward portion of a passenger vessel incorporating an openable bow member and having a retractable, concealable bow ramp assembly storable within the vessel in accordance with the present invention, illustrating the bow member in its open state and illustrating the ramp deployed and extended to a shore location, the assembly utilizing the method of the present invention.
Figure 2A:
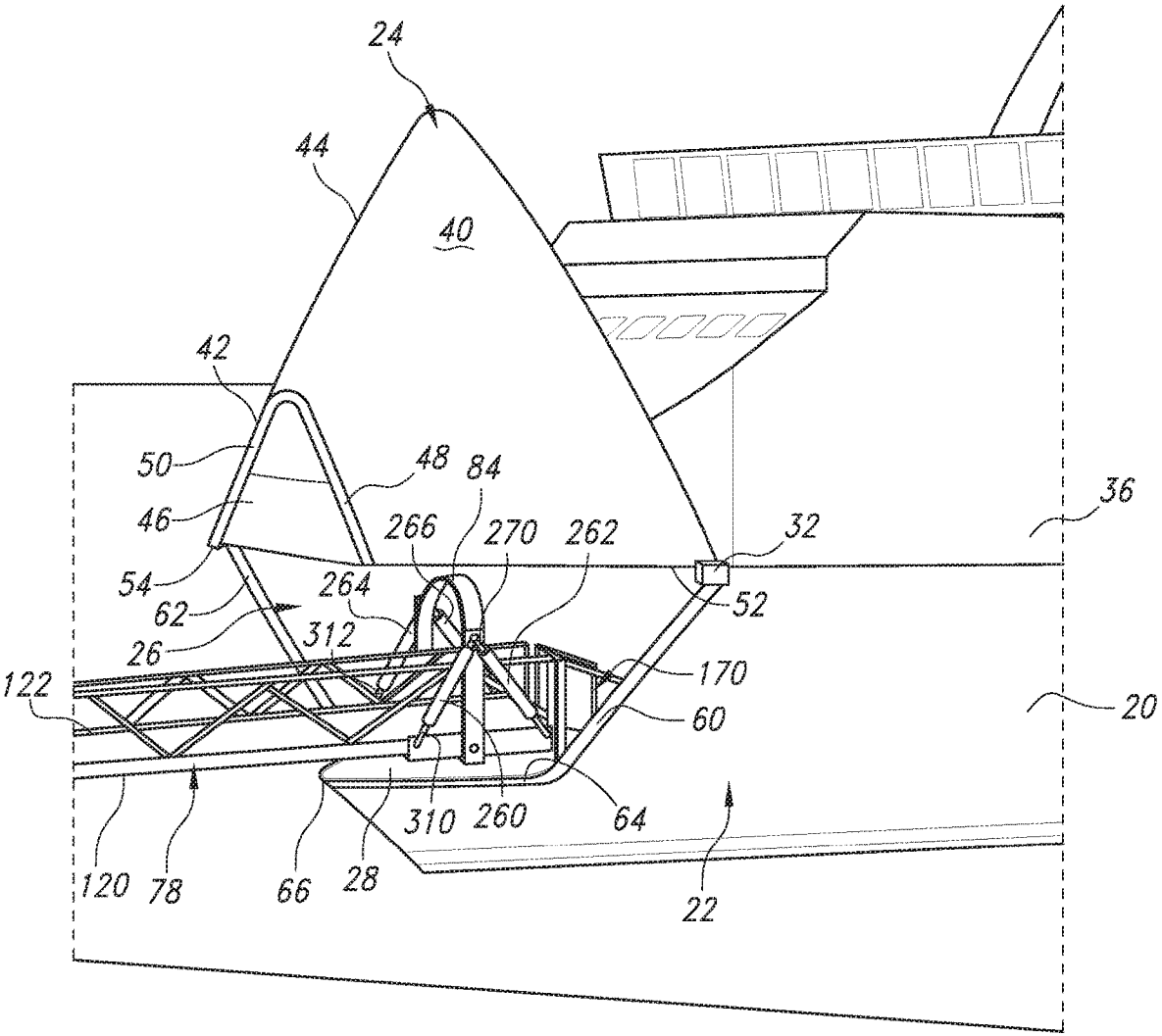
FIG. 2A is an enlarged view of a portion of FIG. 2.
Figure 3:
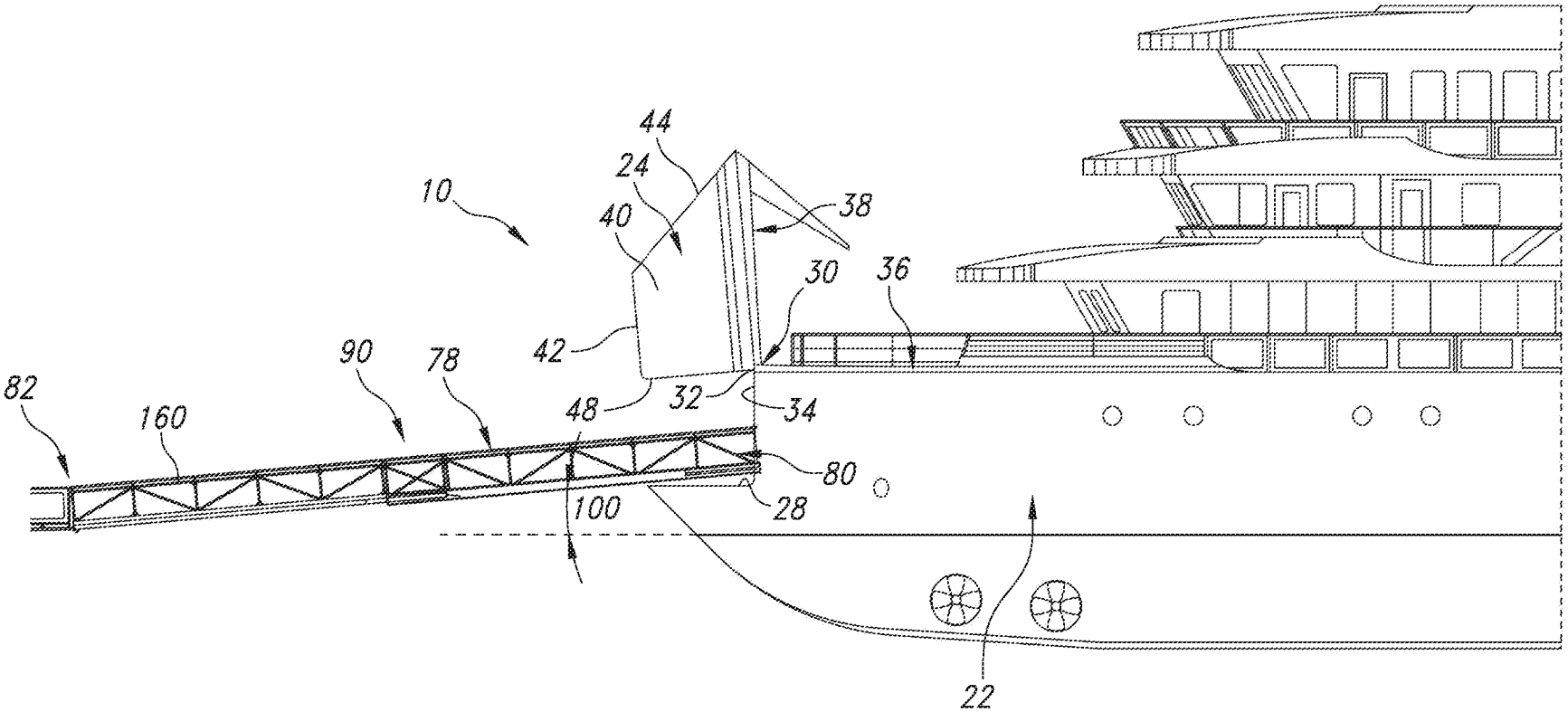
FIG. 3 is a diagrammatic port side view in elevation illustrating an outboard profile of the forward portion of the passenger vessel of FIG. 2 incorporating the present invention, and more specifically illustrating a vessel having an openable bow member in its open state and having a retractable, concealable bow ramp assembly with the ramp assembly deployed and extended, the assembly utilizing the method of the present invention.
Figure 4:
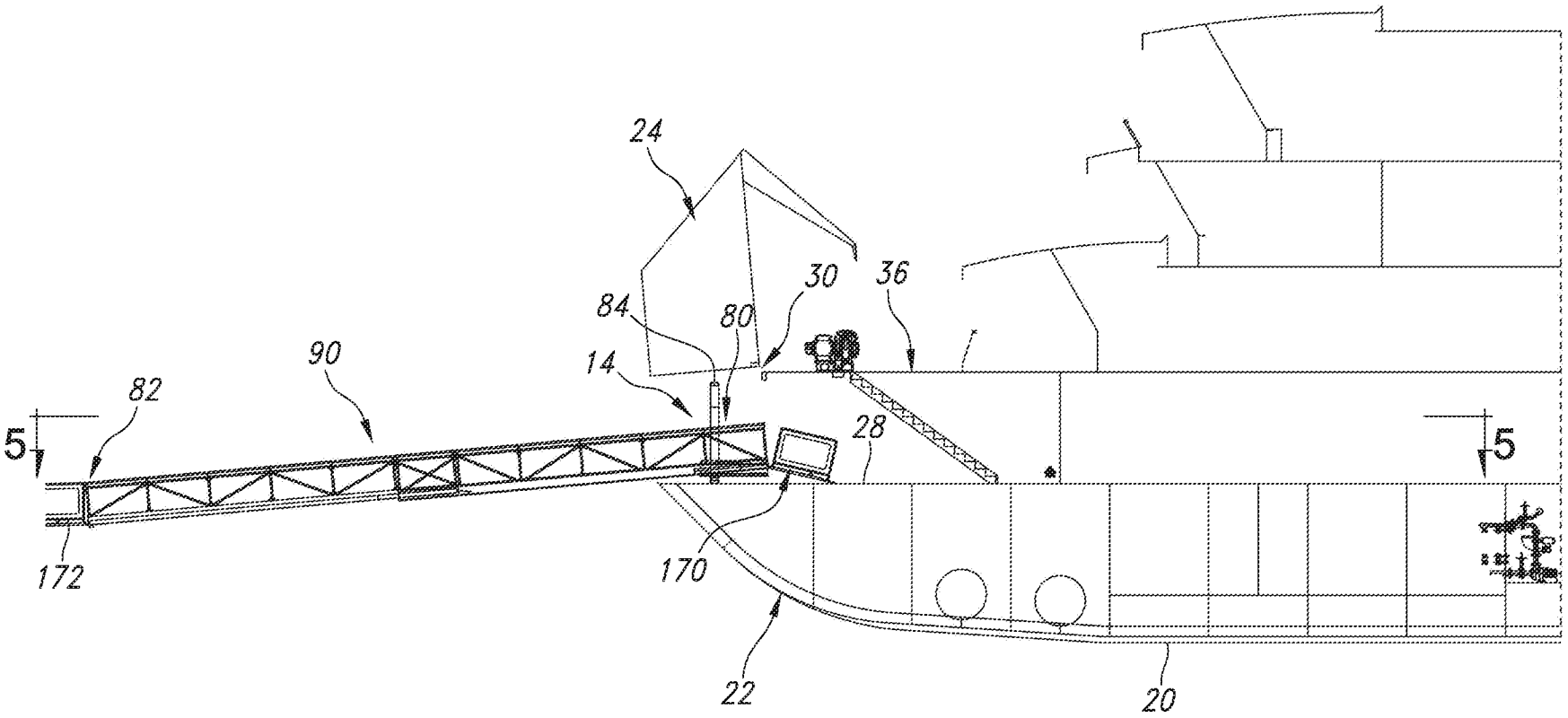
FIG. 4 is a diagrammatic port side cut-away elevational view of the passenger vessel of FIG. 2, providing an inboard profile of a forward portion of the passenger vessel of FIG. 2 incorporating the present invention with the bow member in the open state and the ramp assembly deployed and extended.
Figure 6:
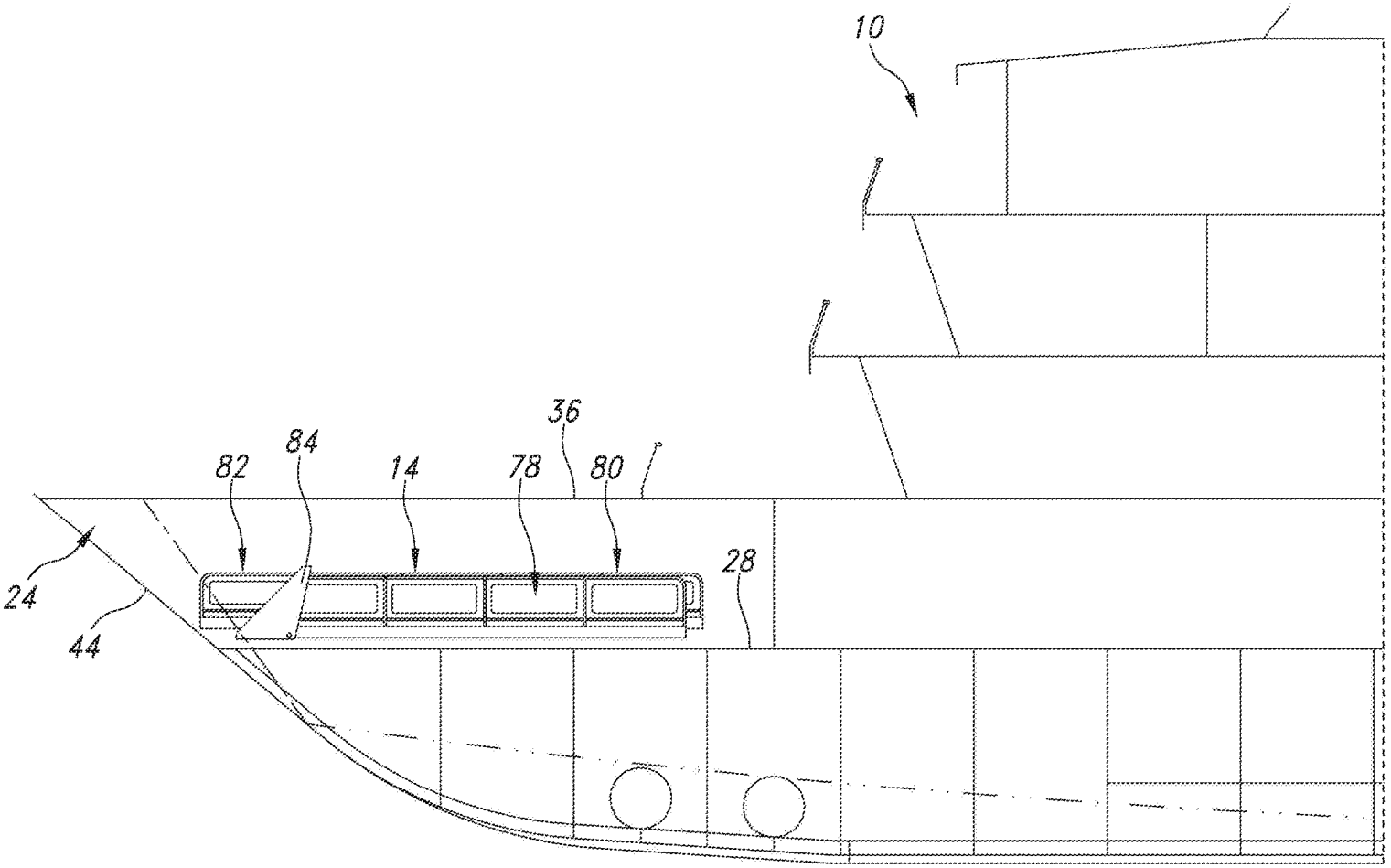
FIG. 6 is a diagrammatic port side cut-away side elevation view of a slightly revised version of the passenger vessel of FIGS. 2-5 and providing an inboard profile of the forward portion of a vessel incorporating the present invention, and more specifically a side view with the bow member in its closed state and with the ramp assembly stowed.
Figure 7:
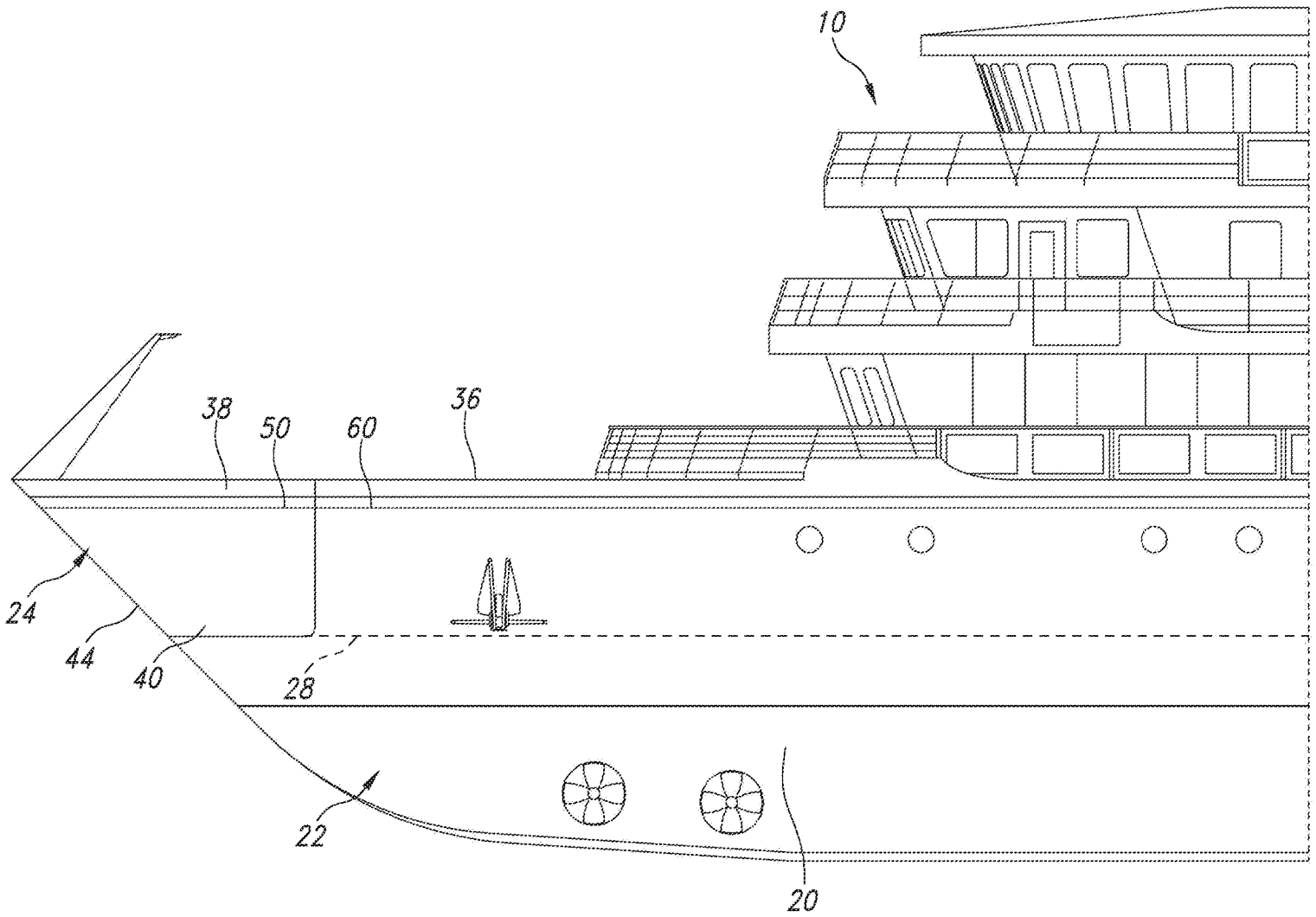
FIG. 7 is a diagrammatic port side view in elevation illustrating the outboard profile of the passenger vessel of FIG. 6 with the bow member in the closed state with the ramp assembly stowed, in accordance with the present invention.
Figure 9:
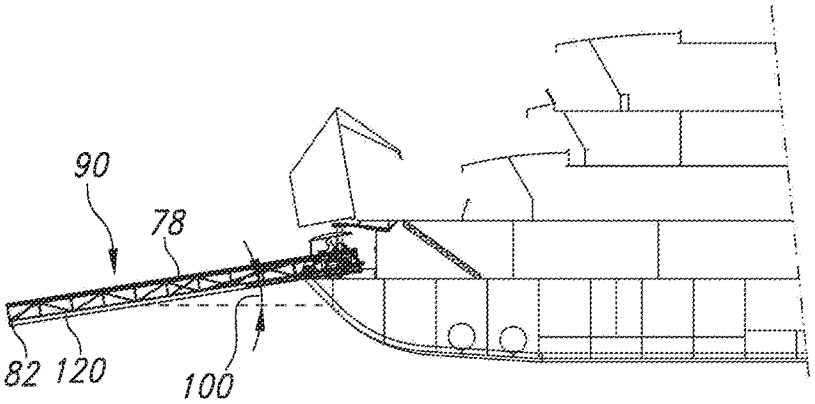
FIG. 9 is a diagrammatic illustration of the vessel of FIG. 5, with the ramp extending forwardly from and pivoted downwardly from the main deck.

In accordance with the preferred form of the invention, at its forward end 22 the hull 20 incorporates a movable bow member 24 configured to be moved between a closed state, as shown in FIGS. 6 and 7, and an open state, as best shown for example in FIGS. 2, 2A and 3. Although the openable bow member 24 is shown as being hinged on its top rearward edge in the illustrated embodiment so as to open upwardly, in alternative embodiments the openable bow member could also be hinged to the hull at one side so as to swing outwardly to one side or the other, or could comprise multiple forward hull segments sliding rearwardly along the hull sides from a closed state to an open state. In any of these alternative configurations the bow member 24 opens to expose a forward opening or access 26 to the interior volume of hull 20 at the level of an intermediate deck surface 28, as best seen in FIGS. 2, 3 and 4). In the illustrated embodiment the movable bow member 24 is mounted at its rearward top edge 30 to a suitable pivot axis 32, which may be, for example, a transverse hinge, shaft or axle mounted along the upper edge 34 of opening 26. The pivot hinge or axis 32 may be secured between the port and starboard sides of the hull 20 and/or on an upper deck 36 and extending the width of the vessel, alternatively may consist of suitable axle pins mounted on the hull at each side of the bow member, or may be another suitable mounting arrangement to enable the bow member to be upwardly (clockwise as viewed in FIGS. 2 and 3) pivoted at a hinge axis area 32 at upper deck edge 34 located at the forward end of the upper deck 36 and defining the upper edge of opening 26.

The illustrated bow member 24 includes as its top surface a bow portion 38 of the upper deck 36 which serves as a continuation of the deck when the bow member is closed. The movable bow member 24 has as its side walls forward portions 40 and 42 of the port and starboard sides of the forward portion 22 of hull 20, respectively (FIGS. 2 and 2A), which meet at the prow 44 of the vessel. The bottom of bow member 24 is formed by a bottom wall 46 defined by bottom edges 48 and 50. The bow member sides 40 and 42 have rear edges 52 and 54, respectively, which engage corresponding front edges 60 and 62 of the port and starboard sides of the hull 20. These edges 60 and 62 define the sides of opening 26, while the intermediate deck 28 and deck edges 64 and 66 (see FIG. 5) define the bottom of opening 26. It will be noted that FIGS. 2, 2A, 4, 7, 8 and 9 illustrate the rear edges 52 and 54 and the corresponding hull front edges 60 and 62 as sloping downwardly and forwardly, while in FIG. 3 these edges are vertical. This illustrates that the particular slope is a matter of design choice and can vary in accordance with the convenience of interior design, exterior aesthetics or the like. When the bow member 24 is closed, as illustrated diagrammatically in FIGS. 6 and 7, rear edges 52 and 54 of the bow member 24 engage the hull edges 60 and 62, respectively, and the bow member bottom edges 52 and 54 engage deck edges 64 and 66, respectively, to close and seal the opening 26 so that the vessel is sea-worthy, as illustrated in FIG. 7.

Figure 10:
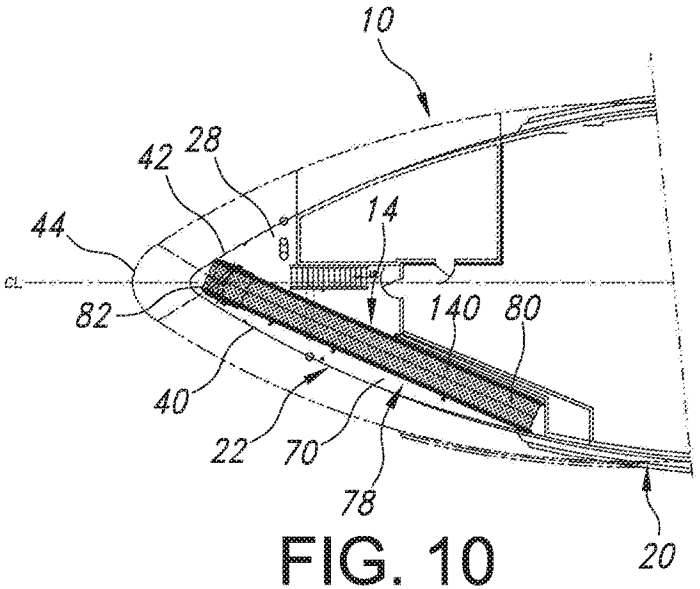
FIG. 10 is a diagrammatic illustration of the vessel of FIG. 5, with the ramp retracted to a position on the main deck and substantially parallel to the port side of the hull.

As illustrated in the diagrammatic cut-away side elevation view of vessel 10 in FIG. 6, and in the similarly cut-away top view of FIG. 10, in accordance with an example of the present invention the concealable, extendable and steerable ramp or gang-plank assembly 14 is retracted and stowed in the hull's interior volume when the bow member 24 is in the closed state. As illustrated, the ramp assembly 14 is mounted between the intermediate deck 28 and the upper deck 36, and in this embodiment is located in a storage area 70 adjacent and substantially parallel to the port side of vessel hull 20. It will be understood that this location is for purposes of illustration, and that the ramp assembly may be retracted and stowed near the starboard side of the vessel hull, along the hull's centerline, or at any convenient location within the forward end of the hull as required or convenient for a particular vessel's deck layout and design. Such alternatives are not illustrated since they are simply a matter of design choice.

Figure 5:
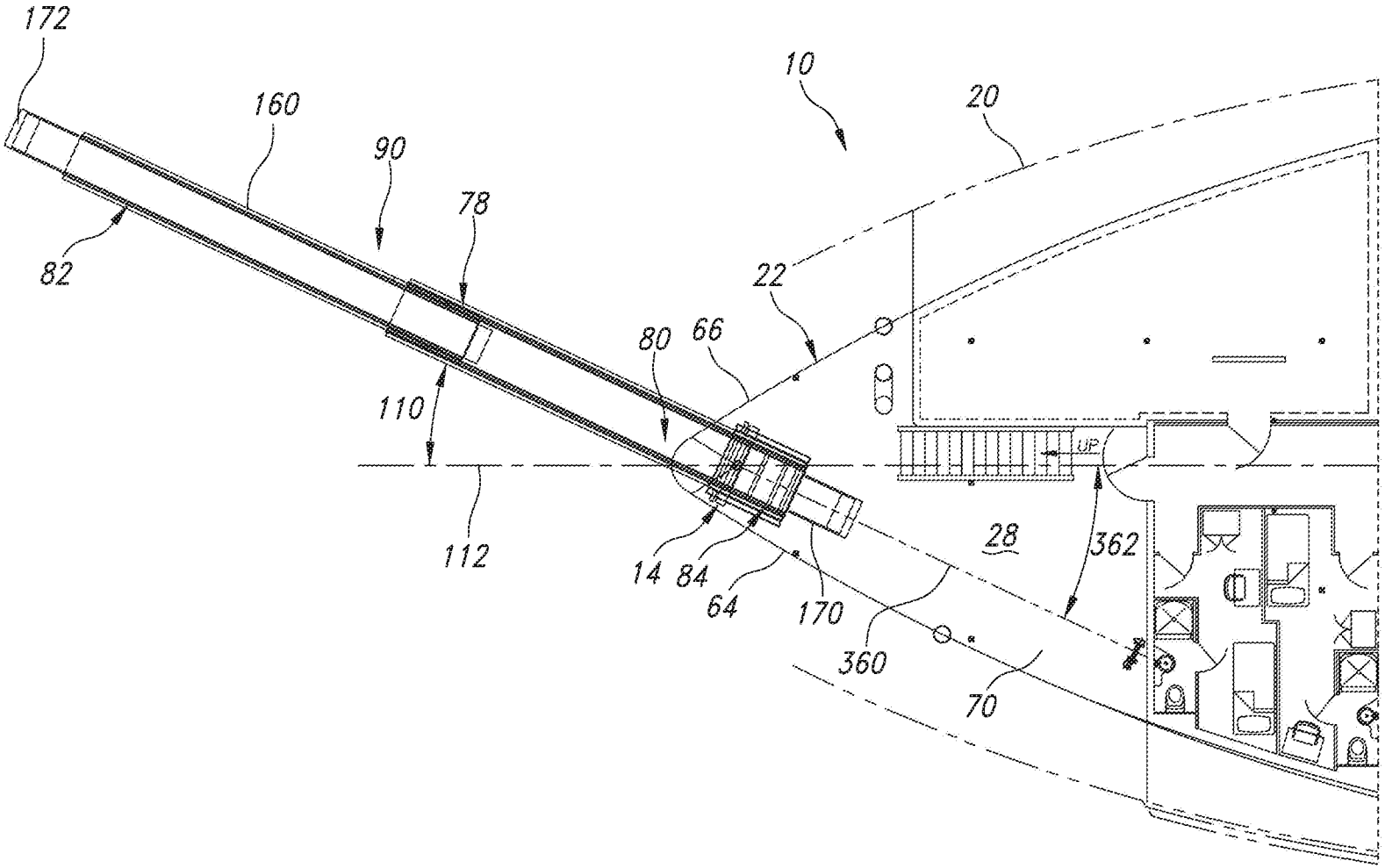
FIG. 5 is a diagrammatic cross-sectional view of the forward portion of the passenger vessel of FIGS. 2, 3 and 4, taken along line 5-5 of FIG. 4 and illustrating the vessel's main deck plan with the ramp assembly deployed and extended, in accordance with the present invention.
Figure 11:
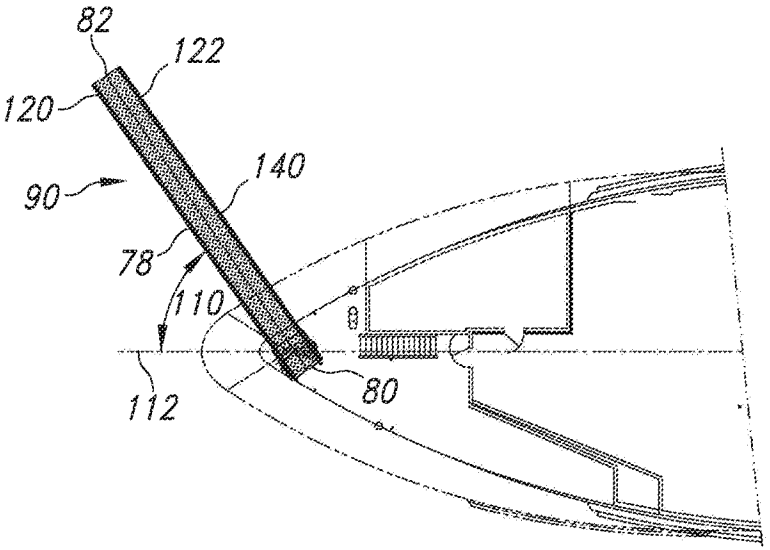
FIG. 11 is a diagrammatic illustration of the vessel of FIG. 5, with the ramp deployed forwardly from and substantially parallel to the main deck and pivoted clockwise toward the starboard side of the vessel.
Figure 8:
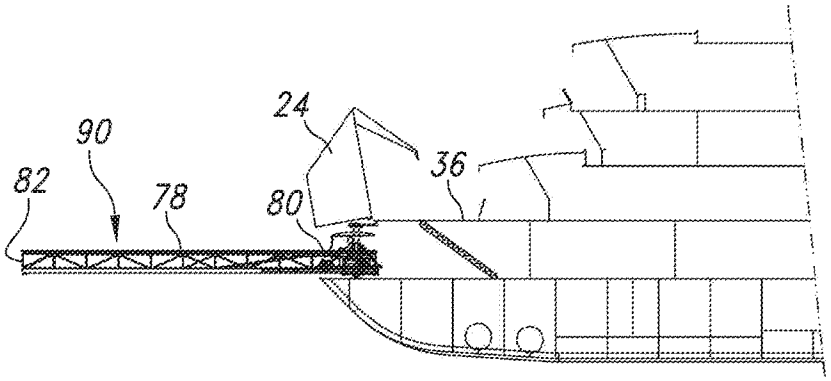
FIG. 8 is a diagrammatic illustration of the vessel of FIG. 5, with the ramp extending forwardly from and substantially parallel to the main deck.

In the illustrated embodiment as best seen in FIGS. 6 and 10, when the bow member 24 is closed the elongated extendable ramp or gang-plank assembly 14 is secured within the hull's interior volume between the intermediate deck surface 28 and the upper deck 36, and more particularly is stowed in the designated area 70. Assembly 14 includes a ramp or gangway 78 having a proximal, or near, end 80 in the selected stowed location near the port side of hull 20 and a distal, or far end 82 within the movable bow member 24 near the prow 44. The ramp assembly 14 further includes a mounting frame, or yoke, 84 that is a trunnion assembly which enables the ramp to rotate in a horizontal plane about a vertical axis and to pivot in a vertical plane about a horizontal axis to provide controllable motion of the ramp in both planes. In the illustrated embodiment the mounting frame is secured on the intermediate deck 28 to receive and secure the gangway 78 in the storage area. When the bow member 24 is open, the ramp 78 is extendable distally or forwardly, through the mounting frame 84 and through the bow opening 26 in the manner illustrated in FIGS. 2-5, 8, 9 and 11. The mounting frame incorporates suitable hydraulic or electrical power sources to extend the ramp distally beyond the bow to the distally projecting ramp extension position generally indicated at 90 (FIGS. 2-4, 8, 9 and 11). The extended ramp 78 is supported in and steerable by the mounting frame so that its distal end 82 can be raised or lowered through a selected vertical angle 100 such as that illustrated in FIGS. 3 and 9. Although the ramp 78 is illustrated as being extended downwardly from the plane of deck 28, it will be understood that it can also be raised through a selected angle upwardly from the plane of this deck. The extended ramp 78 can also be stewed laterally through a selected angle 110 defined beyond the bow, as illustrated in FIGS. 5 and 11. Although these Figures illustrate the extended ramp as being positioned laterally to the starboard side of the center line 112, it will be understood that the lateral motion of the ramp may be through a selected ramp steering angle to either the port or starboard side of the hull center line. As will be described, the ramp angles are controlled from the mounting frame 84, with the extended ramp cantilevered from mounting points at the frame. In one embodiment, the frame may be mounted at its bottom and top on a vertical axis between the decks 28 and 36 for rotational motion to swing the ramp laterally and may incorporate a horizontal pivot axis about which the distal end of the ramp is raised and lowered when the ramp is extended. In another embodiment the frame may be stationary and secured to deck 28 with the ramp mounted for rotational and pivotal movement within the frame.

Figure 12:
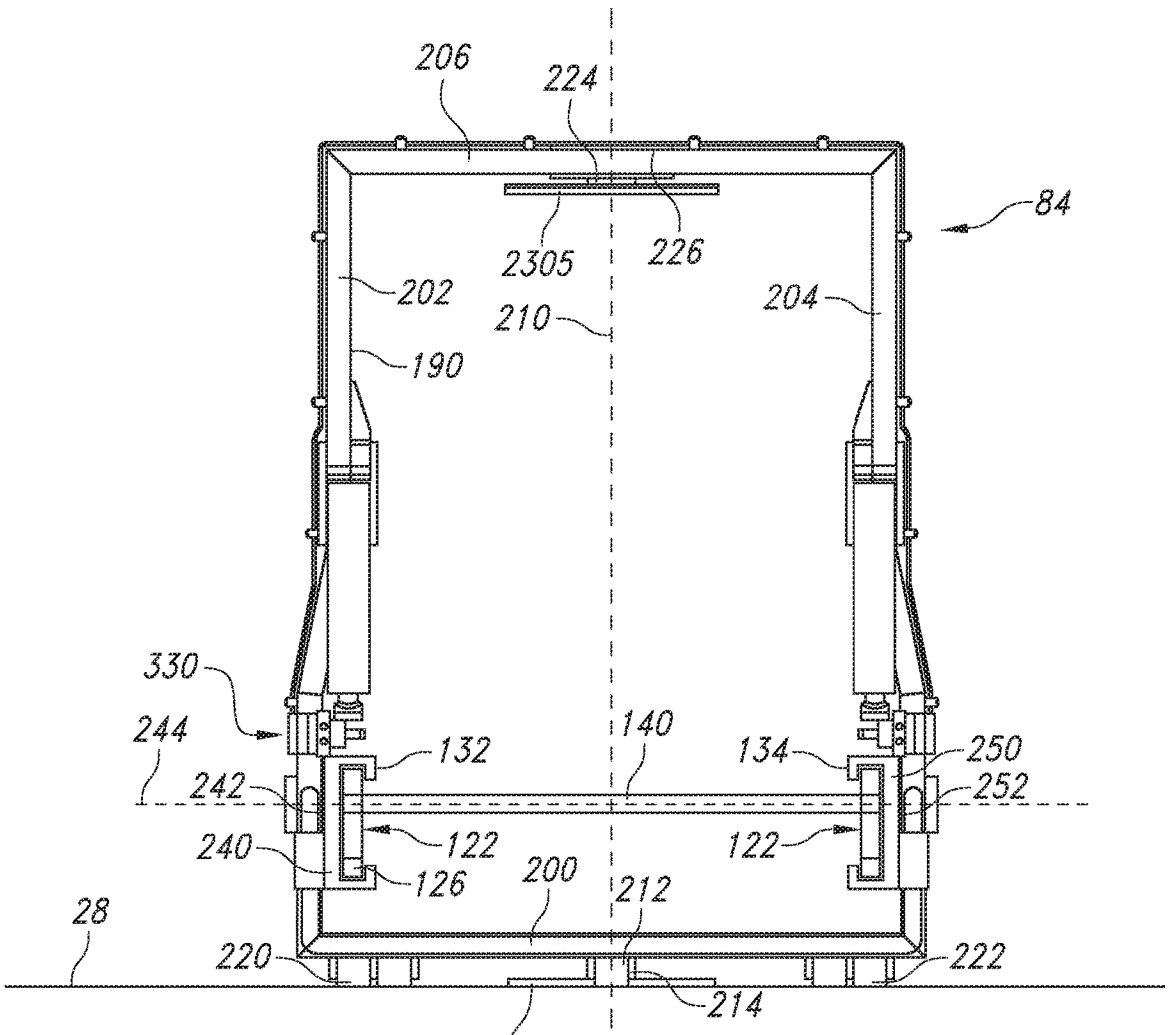
FIG. 12 is a rear (forward-looking) view in elevation illustrating the ramp slew frame portion of the and tilt frame assembly for supporting and securing the retractable bow ramp of the present invention.
Figure 14:
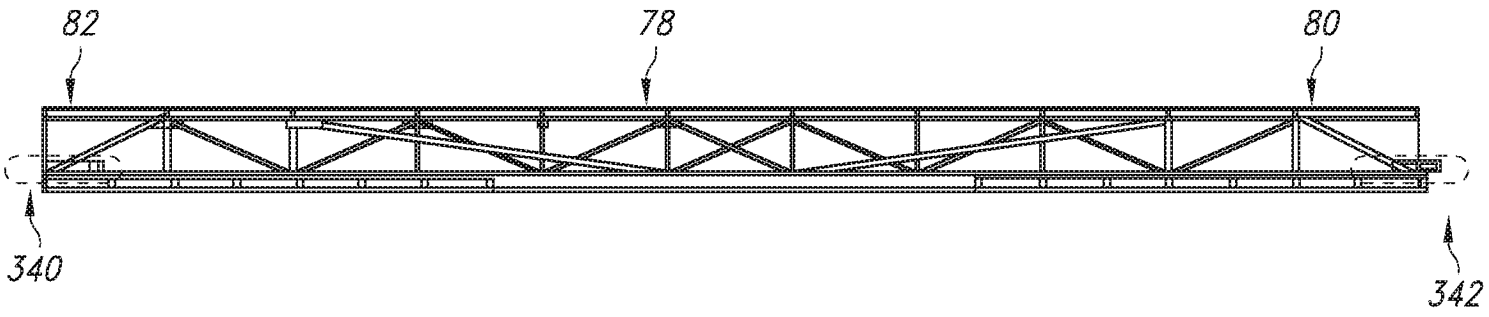
FIG. 14 is a side view, in elevation, of the ramp or gangplank member of FIGS. 2-11, in accordance with the present invention.
Figure 15:
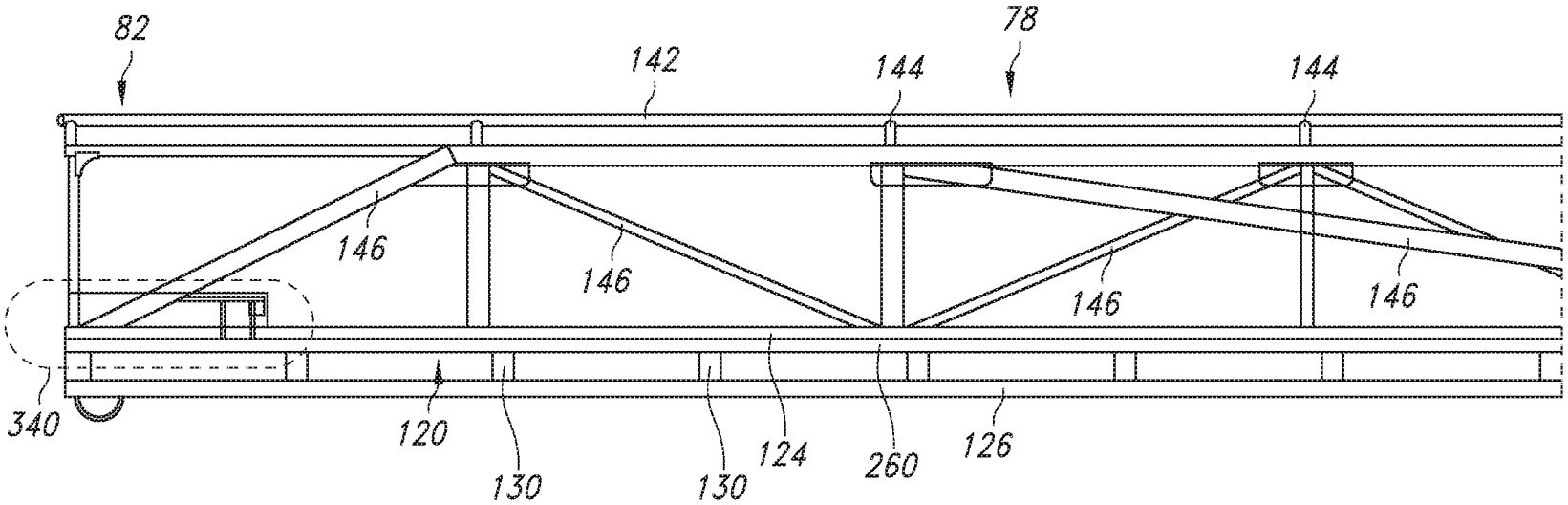
FIG. 15 is an enlarged side view, in elevation, of the distal end of the ramp or gangplank member of FIG. 14, in accordance with the present invention.
Figure 16:
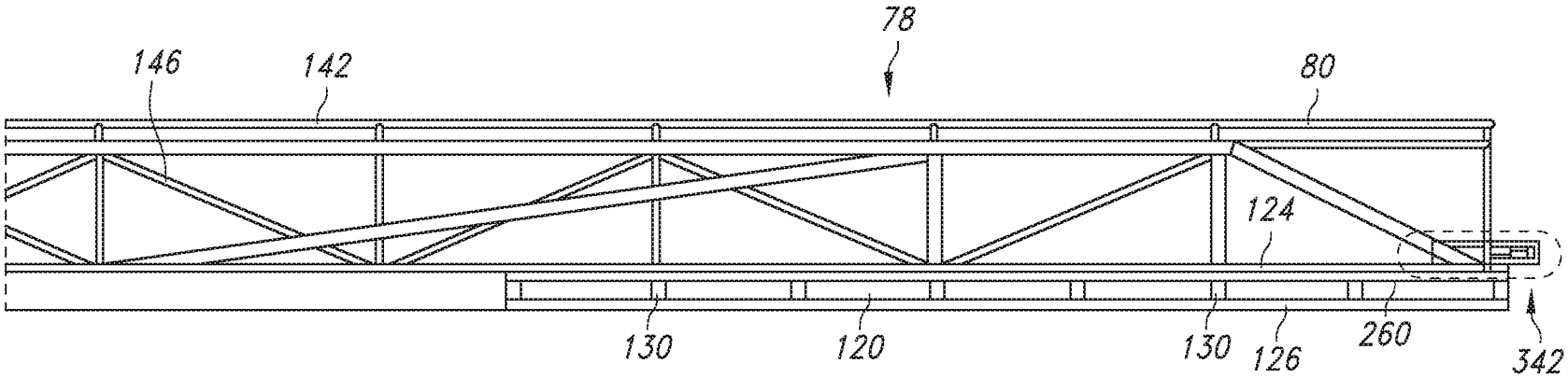
FIG. 16 is an enlarged side view, in elevation, of the near end of the ramp or gangplank member of FIG. 14, in accordance with the present invention.

In a preferred embodiment, ramp 78 is a single unit that is supported by, and slides through, the mounting yoke 84. Thus, the concealable, extendable and steerable ramp or gangplank is preferably configured as a unitary ramp section such as that illustrated in FIGS. 8-11, and in greater detail in the enlarged side views of FIGS. 14-16. The ramp may include a pair of base longitudinal support rails 120 and 122 (FIGS. 2A, 12, and 14-16) each formed by upper and lower guides and spacers such as guides 124 and 126 and spacers 130 illustrated in FIGS. 14, 15 and 16. These support rails engage and rest on corresponding slide supports 132 and 134 inside the stationary yoke 84, one version of which is illustrated in FIGS. 12 and 13, to be described. The ramp includes a walkway 140 (FIGS. 10, 11 and 12) supported by the support rails 120 and 122, a handrail 142 supported by railing posts 144, and a truss structure incorporating angled truss beams 146 to support the ramp when it is cantilevered from the mounting frame or yoke 84 as the ramp is extended and retracted.

In an alternative form of the invention illustrated in FIGS. 2-5, the extendable and steerable ramp or gang-plank 78 is an elongated extendable telescoping unit wherein the ramp distal end 82 is formed on a first ramp section 160 and the opposite ramp proximal end 80 is formed on a second ramp section 162. In this case the ramp support rails 120 and 122 of the first ramp section 160 are constructed to slide within, or telescope into the ramp support rails of the proximal second ramp section 162 when ramp 78 is retracted for storage within the vessel. As described above, when the ramp is retracted and the sections telescoped, the ramp is configured to be stowed with the ramp distal end very near the bow when the bow member 24 is in the closed state. In this configuration the ramp assembly proximal end 80 has passed through the support frame 84 to its stowed position proximate the port hull segment (as indicated in FIG. 5 and illustrated in FIG. 10). As noted, the stowage location alternatively may be proximate the starboard hull segment when the bow member 24 is in the closed state or at any desired location in the forward area 22 of the hull from which the ramp member 78 can be extended through the frame member 84 and the bow opening 26 by being conveyed distally, or forwardly, from the stowed position to an extended position. As needed for specific applications, ramp assembly 14 could be a two-piece telescoping ramp, a one-piece unit or three or more multiple telescoping sections as required to span the distance between the ship and the shore and to fit within the allotted storage space. As best seen in FIGS. 2, 2A, 4 and 5, it may be desirable to provide additional portable ramp extenders such as those illustrated at 170 and 172 that may be secured to the near (proximal) and far (distal) ends 80 and 82, respectively, of the ramp 78 to facilitate passenger access to the ends of the ramp.

As previously described, the ramp assembly 14 is operable to extend the elongate ramp member 78 forwardly or distally beyond the bow to define the distally projecting ramp extension 90. As described and illustrated in the various drawings, the ramp is supported from the mounting frame 84 that is affixed within the hull interior volume to support the ramp in a cantilevered fashion from the bow of the vessel when the bow member 24 is in an open state. The mounting frame can take several forms, and thus may have a generally arched form as illustrated in FIGS. 2, 2A, 4, 5 and 8-11, may be in a squared-off frame shape as illustrated in FIGS. 12 and 13, or may have a low-profile shape as illustrated in FIG. 6. The mounting frame serves to support the ramp and preferably is rotatable with respect to the hull to steer the ramp member's distal end 82 laterally about a vertical axis at the mounting frame. In the illustrated embodiment, the ramp is supported within the frame by pivotally mounted guide members 132 and 134 to steer the distal end of the extended ramp vertically about a horizontal axis at the mounting frame. The ramp thus is steered horizontally in an arc defined beyond the bow through a ramp steering arc angle to either the port or starboard side and is steered vertically in an arc beyond the bow either upwardly or downwardly from a plane parallel to the intermediate deck 28, with the ramp angles being controlled from mounting frame 84. In the preferred embodiment of the invention illustrated herein, the ramp assembly 14 is configured to enable the ramp to rotate about the vertical axis to swing laterally, for example 55 degrees to port or starboard of the vessel centerline in a total arc of 110 degrees, and to enable the ramp end to pivot down 7 degrees and up 17 degrees from a plane parallel to the top of the main (intermediate, or passenger access) deck 28. However, the specific angles of deployment can be varied according to anticipated need, and the lateral motion may be 90 degrees to port and to starboard, if desired. Similarly, the vertical angles through which the ramp may be pivoted may also vary as desired.

Figure 13A:
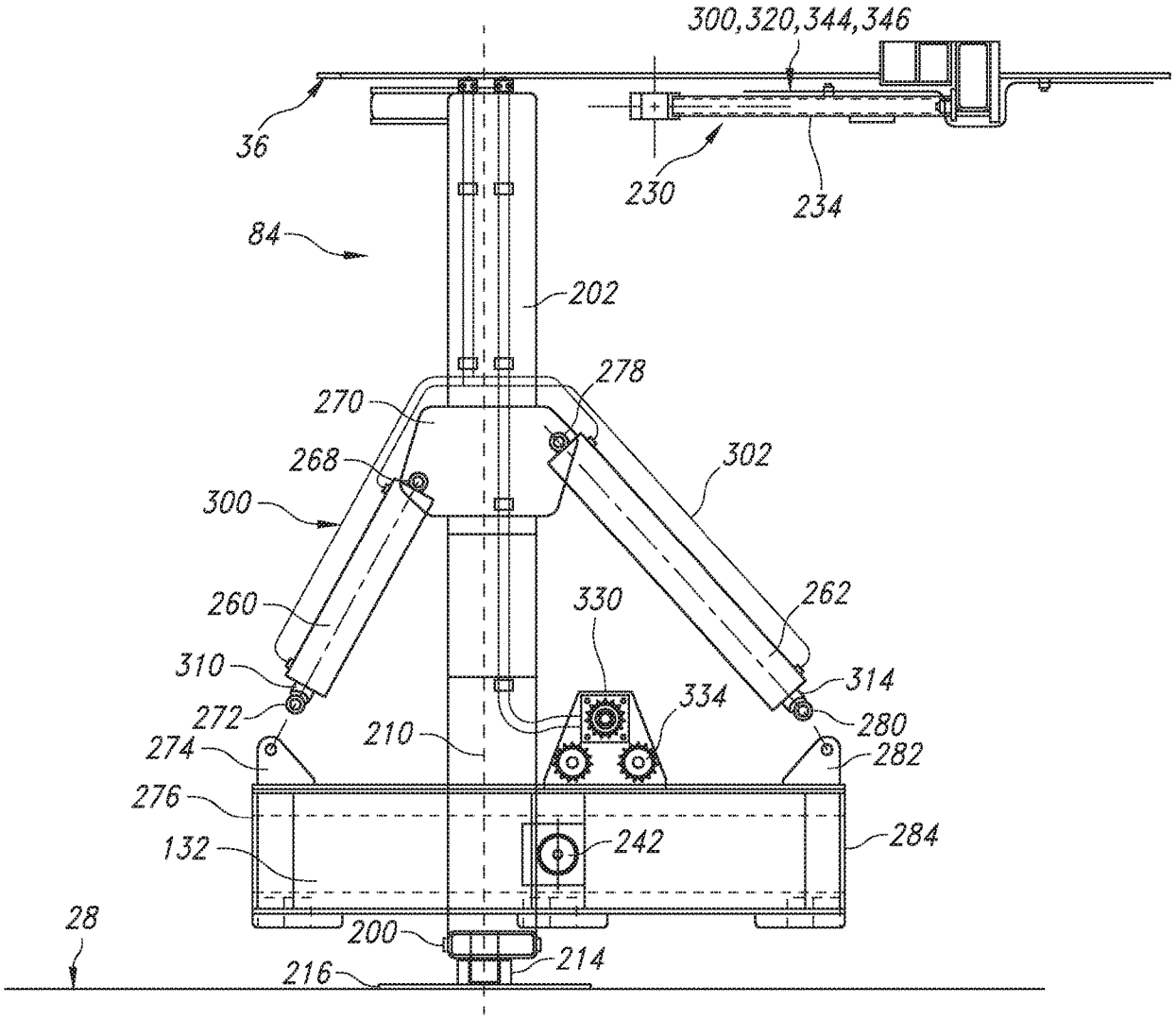
FIG. 13A illustrates a left or port side view in elevation of the slew and tilt frame assembly of FIG. 12.
Figure 13C:
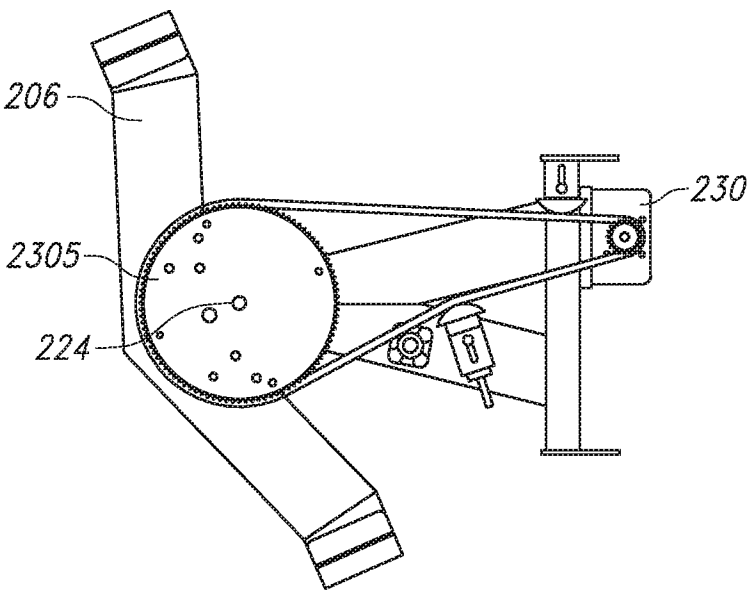
FIGS. 13B and 13C illustrate plan views looking up of the slew sprocket and frame slewing to starboard and to port for the frame assembly of FIG. 12.
Figure 13B:
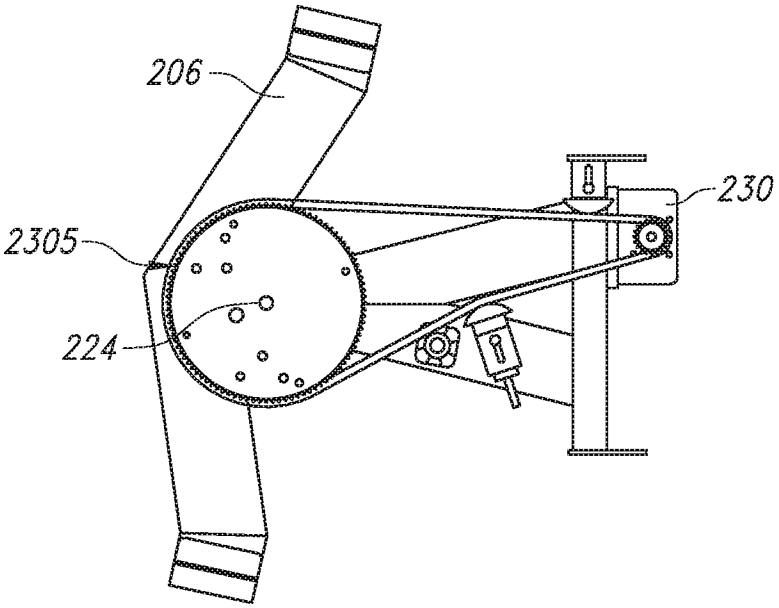
Figure 13D:
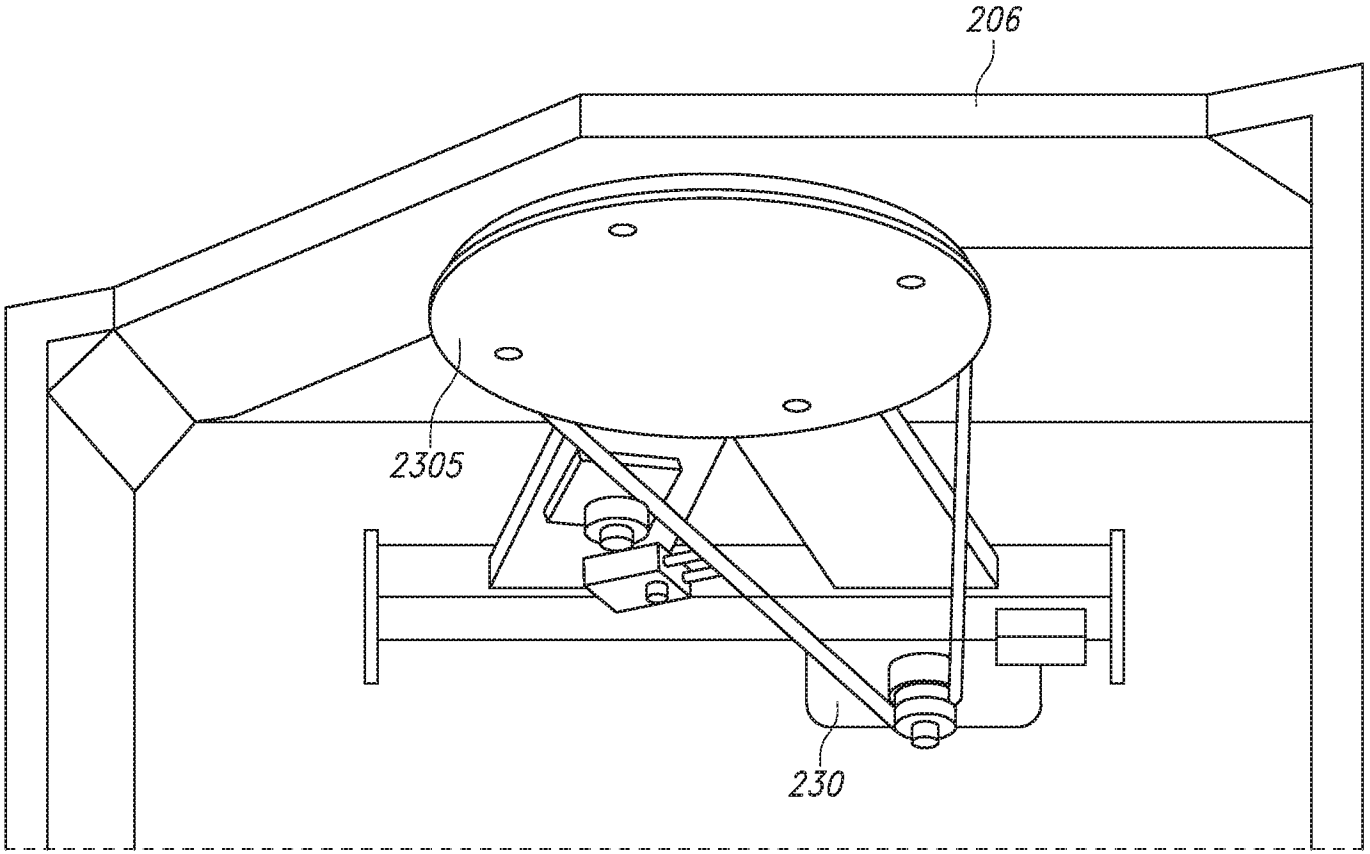
FIG. 13D is a illustrate a left side view in elevation and two perspective views of the slew sprocket drive mechanism for the frame assembly of FIGS. 12, 13A and 13B.

The mounting yoke or frame 84 is best illustrated in FIGS. 12 and 13A-13D, wherein FIG. 12 is a rear elevation view and FIG. 13A is a side elevation view of a preferred form of the invention. The frame includes a support structure 190 which incorporates a bottom, or base cross-member 200 spanning the lateral width of the frame support structure, port and starboard (left and right as viewed in FIG. 12) parallel upright or vertical members 202 and 204 extending the height of the frame, and a top cross-member 206 which spans the lateral width of the frame between the vertical members and which is generally parallel to the bottom member 200. As previously pointed out, if desired the top portions of the vertical members may be curved inwardly to cooperate with the top frame member to form the curved arched top illustrated in FIGS. 2 and 2A. The frame members preferably are tubular, with rectangular cross-sections, and may be of aluminum, steel or other suitable material.

The frame support structure is mounted between the top surface of the intermediate deck 28 and the under surface of the top deck 36 for rotational motion about its vertical axis 210 (FIG. 12). In the illustrated embodiment, the bottom member incorporates a vertical lower pin member 212 axially aligned with vertical axis 210 and located in a corresponding vertical bearing member secured to a support plate 216 mounted on deck 28. Rotational motion is facilitated by wheels or rollers 220 and 222 mounted on frame member 200 and spaced outwardly from pin 212 to engage the surface of the deck 28 to prevent tilting of the frame. Similarly, the top frame member 206 carries a coaxially aligned top pin member 224 which supports rotation of slew frame sprocket 230S about vertical axis 210 and is mounted on a plate 226 secured to member 206 to remain vertically aligned with axis 210. The top pin 224 is rotationally secured to the frame member 206 in a vertical position for rotational motion. In the illustrated embodiment as best seen in FIGS. 13A, 13B, 13C and 13D, the top pin 224 is mounted in a bearing element that is also secured to a support beam 232 beneath the upper deck by way of an extension arm 234. Although the support for the upper pin 224 is illustrated as coaxially supporting slew frame sprocket 230S, it will be understood that it may incorporate multiple arms, such as two arms in a V-pattern or additional lateral or forward-extending arms to provide the necessary stability for the upper end of frame 84. The drive mechanism employed to laterally slew (or rotate the frame assembly 84 about vertical axis 210) from port to starboard includes slew frame sprocket 230S (see, e.g., FIGS. 13B, 13C and 13D) driven by a hydraulic motor 230 via a tensioned chain. Alternatively, an electric motor could be used in the slew frame mechanism.

As described above, the ramp 78 is mounted for longitudinal, or axial, motion through the frame 84 by way of support rails 120 and 122 which incorporate upper and lower slide tubes such as those illustrated at 124 and 126 for rail 120 (see FIGS. 14-16) that engage and rest in corresponding slide supports 132 and 134 pivotally mounted inside the stationary yoke 84 on vertical posts or frame members 202 and 204, respectively. Slide support 132 is generally C-shaped as viewed in cross-section (FIG. 12) and includes a vertical back wall 240 secured to a horizontal pivot axle 242 mounted on frame member 202 and centered on a horizontal pivot axis 244 for pivotal motion with respect to the vertical frame member. Similarly, the slide support 134 is C-shaped as viewed in cross-section (FIG. 12) and includes a vertical back wall 250 secured to a horizontal pivot axle 252 mounted on frame member 204 and centered on the horizontal pivot axis 244 for pivotal motion with respect to the vertical frame member. The C shapes of the slide supports 132 and 134 are provided to partially enclose the rails 120 and 122 of the ramp 78, with the walkway or ramp deck 140 extending across the width of the frame 84 (FIG. 12), to enable the ramp to extend and retract (that is, to slide forwardly and rearwardly, or to the left and to the right as viewed in FIG. 13A) in operation.

The slide supports are tilted, or pivoted about axis 244, by a drive mechanism which may include, for example, hydraulic (or pneumatic) cylinders such as front and rear cylinders 260 and 262 connected to slide support 132 and front and rear cylinders 264 and 266 connected to slide support 134 (see FIG. 2A). As best seen in FIG. 13A, the front cylinder 260 is connected at its upper end 268 to a mounting plate 270 on vertical frame member 202 and is connected at its lower end 272 to a tab 274 formed on the forward end 276 of the slide support 132. The rear cylinder 262 is connected at its upper end 278 to the mounting plate 270 on vertical frame member 202 and at its lower end 280 to a tab 282 formed on the rearward end 284 of the slide support 132. In similar manner, the upper and lower ends of cylinders 264 and 266 are connected between an upper plate on the vertical frame member 204 and the forward and rearward ends of the slide support 134. These cylinders are connected to suitable fluid lines 300 and 302 wherein the fluid pressure is controllable to raise and lower the distal end of ramp 78. Thus, to tilt the slide supports 132 and 134 clockwise as viewed in FIG. 13A to raise the distal end of the ramp upwardly, increased pressure in line 300 is supplied to the lower ends of cylinders 260 and 264 to force their respective pistons upwardly to retract their corresponding rods 310 and 312 and is simultaneously supplied to the upper ends of cylinders 262 and 266 to extend their respective pistons downwardly to extend rods 314 and 316 (316 not shown), thereby pivoting or tilting the slide supports in a clockwise direction as viewed in FIG. 13A. To lower the distal end of the ramp, fluid pressure in lines 300 is released and pressure is applied to fluid lines 320 to pressurize the upper ends of cylinders 260 and 264 and to pressurize the lower ends of cylinders 262 and 266, thus reversing the direction of the pistons in these cylinders and tilting the slide supports 132 and 134 counterclockwise.

Figure 17:
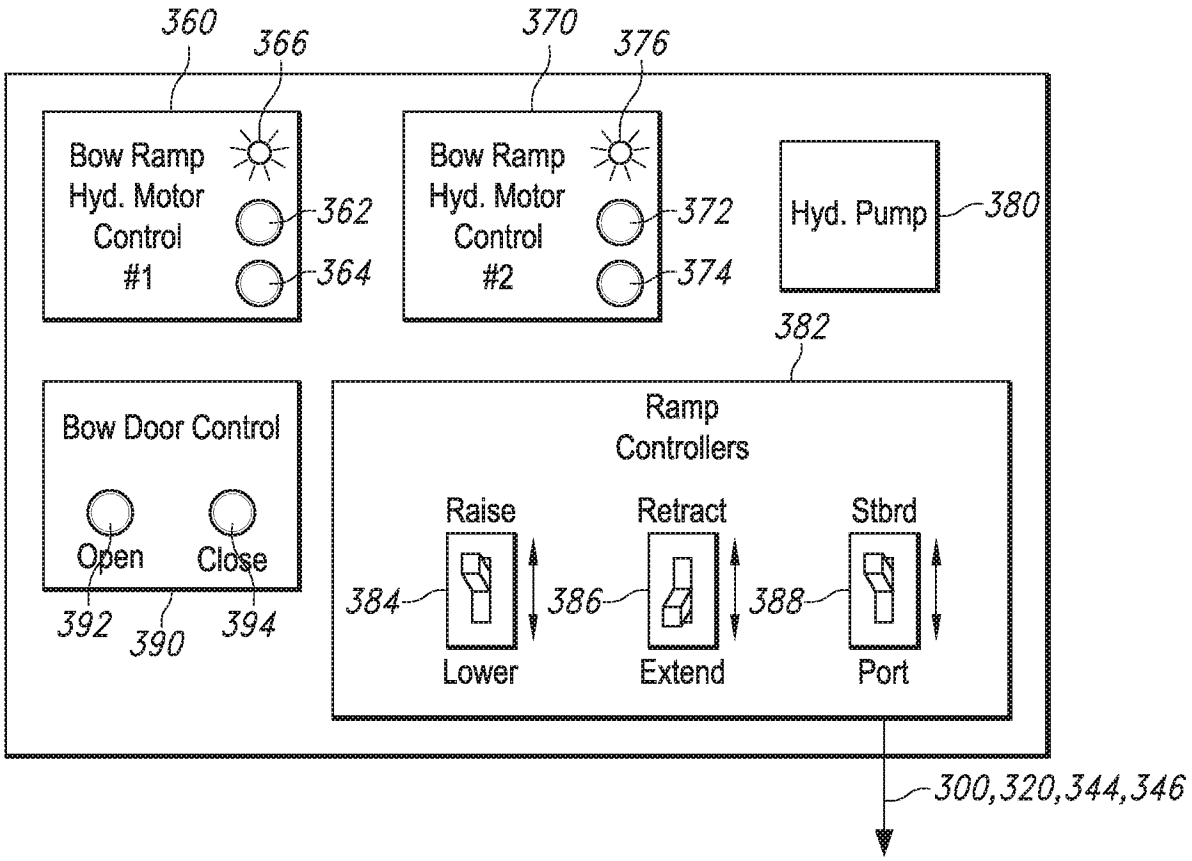
FIG. 17 is a diagrammatic illustration of an exemplary controller for the ramp assembly of the invention.

The ramp 78 is driven for extension and retraction by a suitable reversible motor such as a hydraulic motor 330 mounted on the slide support 132. This motor drives, for example, a pair of toothed drive wheels 332 and 334 that engage a chain (not shown) connected to drive wheels 340 and 342 at the distal and proximal ends, respectively, of ramp 78. Fluid pressure selectively applied to the motor 330 through hydraulic fluid lines 344 and 346 drive the motor in a selected direction to extend or retract the ramp through the frame 78. The fluid lines 300, 320, 344 and 346 are connected to a suitable hydraulic (or pneumatic) pressure source and control panel 350 (FIGS. 13 and 17). It will be understood that alternative steering mechanisms such as electric motors can be used to tilt, extend and retract, and to rotate the ramp when bow member 24 is in the open state.

A control system for the bow member 24 and the ramp assembly 14 is diagrammatically illustrated in FIG. 17, wherein the controller 350 incorporates a first bow ramp hydraulic motor control 360 having "on" (start) and "off" buttons 362 and 364 and an indicator lamp 366, and a second bow ramp hydraulic motor control 370 having "on" (start) and "off" buttons 372 and 374 and an indicator lamp 376. The controls 360 and 370 switch on and off a hydraulic fluid sources 380 to provide fluid to ramp controls 382 having, for example, manually operated control levers such as raise/lower lever 384, retract/extend lever 386, and starboard/port lever 388 for directing fluid under pressure to the control motors at mounting frame 84 for extending, retracting, rotating and pivoting the ramp 78. The controller 350 also includes a bow door control 390 having open and close switches 392 and 394 for operating the bow member 24. Although these controls are illustrated in an enclosed box 350, this is for convenience of illustration and it will be understood that the various controls may be located within the vessel as required for efficient and safe operation of the system of the invention.

The method of the present invention includes operating a passenger vessel 10 to embark or disembark passengers and crew or to load and unload stores or other items by way of a bow access opening when moored along either an improved or unimproved shoreline. The method comprises the steps of: (a) providing a vessel 10 having a hull 20 with a movable bow member 24 configured to be moved between a normal closed state and an open state which exposes an interior volume of the hull; (b) providing an extendable and steerable ramp or gang-plank assembly 14 including an elongated retractable and extendable ramp or gang-plank member 78; (c) stowing assembly 14 in its retracted state within the said interior volume of the hull when the bow member 24 is in the closed state; (d) when retracted, locating a proximal end of the ramp in a stowage location 70 on a vessel deck 28 and locating a distal end of the ramp within the closed bow member; (e) mooring the vessel adjacent an improved or unimproved shore line; (f) opening the bow member to expose the ramp assembly 14; (g) extending the ramp 78 through the bow opening forwardly of the hull 20, and (h) steering the distal end 82 of the ramp 78 to contact and rest on the adjacent shoreline. Before the vessel departs from the mooring, the ramp is removed from the adjacent shoreline and stowed within the hull, in accordance with the further method steps of (i) rotating the distal end 82 of ramp 78 horizontally to a predetermined beginning position in alignment with its prior stowed location in the hull; (j) pivoting the ramp distal end 82 to raise or lower it vertically until it is parallel to the deck 28; (k) retracting the ramp into its stowage location; and (l) closing the bow member 24 to conceal the ramp.

In summary, persons of skill in the art will recognize that the passenger vessel 10 incorporating the retractable, concealable bow gangway assembly 14 having a ramp 78 supported in a slew and tilt frame assembly 84 and utilizing the described method for deploying, steering, retracting and concealing the gangway in accordance with the present invention provides the advantages of allowing the vessel to moor at any unimproved shoreline that accommodate the vessel to provide a safe and efficient method of moving passengers, crew, stores, etc. between the ship and shoreline. The bow ramp mechanism can also be used at an improved dock side facility where it is desired to load or unload the vessel via the bow. In use, vessel 10 can moor parallel or near parallel to a shoreline to minimize the effects of any currents on the vessel hull 20 and to minimize the intrusion of the vessel into channels or navigation waterways along the shoreline. Advantageously, bow ramp 78 can be deployed toward either side of the vessel to allow the vessel to moor into the current regardless of which shoreline it is moored to. Furthermore, the ramp can be retracted into the vessel's bow for protection of the ramp when it is not in use, advantageously concealing and protecting the ramp assembly and mounting frame assembly when not in use, thereby providing a more elegant exterior visual appearance. As noted above, the ramp or gangplank assembly 14, when deployed from the hull can be steered horizontally to either side of the hull and can also be steered or pivoted down to a selected down angle (e.g., 7 degrees) or up angle (e.g., 17 degrees) from a horizontal plane formed by the top of the intermediate deck 28, which is the storage deck and is also the passenger access deck to the ramp 78. The lateral and vertical angles of motion of the ramp are selected for particular vessel configurations and uses. As described, to retract and stow the ramp the forward or distal end must be aimed for retraction into the desired storage location 70 within the hull's interior surface, and so is stewed or rotated using mounting frame 84 to a selected retraction aiming angle (e.g., 22 degrees to starboard as shown in FIGS. 5 and 10) and the ramp distal end 82 is steered or pivoted vertically until parallel to the storage deck.

As described above, the movable member 24 forming a segment of the bow of vessel 10 can be of one or more sections and hinged or sliding, as required to suit the bow configuration of the vessel being fitted with the retractable bow ramp assembly 14. The movable ramp 78 is mounted in a trunnion assembly or mounting frame 84 secured in the interior of the hull near the bow of the vessel. The trunnion assembly serves three functions: to extend or retract the ramp; to swing the extended ramp left or right; and to raise or lower the outboard (distal) end of the ramp. The invention works in a three-step process after the vessel has been moored alongside the shoreline, either with or without any improved shore side docking facilities. Once moored, the vessel's movable bow section is opened; the bow ramp is extended distally or forwardly from its concealed storage space within the bow; and the bow ramp is rotated horizontally (or slewed) either left or right and pivoted (or tilted) vertically up or down to land the bow ramp's distal or outboard end ashore. Retraction of the bow ramp after use is the reverse of the steps used to deploy the bow ramp, once the ramp has been steered into the selected retraction aiming angle (for example, 22 degrees to starboard for the particular vessel configuration illustrated). The concealed retractable bow ramp thus allows for the movement of passengers, crew, stores, and other items between the vessel and the shore where shore access is only available at unimproved locations via the bow of the vessel.

The vessel's openable bow segment or door 24 is designed to allow the crew to safely open the bow to allow the retractable gangway 78 to extend forwardly from the ramp storage deck (the described interior or intermediate passenger access deck) 28 directly to a riverbank or a dock. The bow, once opened, provides lateral clearance permitting the gangway or ramp to easily rotate laterally so that the gangway gives the ship the ability to make "bow landings" wherever needed. This feature gives the vessel of the present invention an array of options for passenger itineraries and pleasure cruise destinations.

To illustrate the operation of the bow ramp of the invention in a test installation and thus to further illustrate the method of the present invention, the following crew instructions for the prototype installation were provided and successfully used in operating the bow gangway installation of the present invention:

A. Do not operate the bow door or bow ramp unless:

1. All crew members involved are fully trained and briefed on their duties.
2. There is a designated lead person who is fully trained on their duties as the lead person as well as all of the duties of all other persons involved.
3. All crew members are wearing work life vests and appropriate shoes, clothing and other appropriate safety gear.
4. The bow door and ramp areas have been cleared of all passengers and any other crew members who are not directly involved in operating the bow door or bow ramp.
5. The bow door and ramp areas have been cleared of all passenger access ramps and boxes, mooring lines, heaving lines, golf cart power cords, etc.
6. The Captain or Mate on watch has given direct approval to start any bow door or bow ramp operations.
7. There is adequate radio communication between the main deck crew, 2nd deck crew, and bridge when doing any bow door or bow ramp operations.

B. When operating the bow door or bow ramp always:

1. Before starting the bow ramp hydraulic power units always make sure the main deck hydraulic control valves are in the middle position and the Float Safety Plate is in the down and locked position.
2. Always make sure the main deck hydraulic control valve Float Safety Plate is in the down and locked position at any time the bow ramp hydraulic power units are running.
3. DO NOT lift the Float Safety Plate and put any of the three control levers into their fully up (float) position unless the ramp has been landed securely ashore and the bow ramp hydraulic power units are turned off. If any of the control levers are put in the float position with the ramp not securely landed ashore, the ramp can be moved quickly with no control.

4. Before operating a control lever or button always;
   A. Check that all areas around the bow ramp and door are clear of all obstructions and persons not involved.
   B. Check that the lever or button control is the correct one desired and will move the bow door or ramp in the desired direction.
5. Operate the main deck lever controls gently and move them only enough to slowly move the ramp. Do Not jerk or slam the ramp about at any time.
6. Do Not force the bow door up or down. If the door does not move or appears to be binding immediately stop and check that the locks are clear and the safety bars are free to move.
7. Do Not force the bow ramp in any direction. If the bow ramp will not move or appears to be binding immediately stop and check that the ramp is clear to move.
8. If the bow door or ramp will still not move or appears to still be binding after doing the checks in warning #6 and #7, immediately stop, turn off the hydraulic pumps and await directions from the Captain or Mate on watch.

C. Opening Bow Door Instructions

1. Check that all crew members are assembled, wearing work life vests, and are fully trained and briefed on their duties. Improper operation of the bow door can damage the vessel and/or cause severe injury or death.
2. Station two (2) crew members on the main deck forward and two (2) crew members on the 2nd deck forward with radios.
3. Check that all passengers and other persons not involved with the bow opening are clear of the ramp and the bow doors.
4. Verify all areas around the bow ramp and door are clear of all obstructions and persons.
5. Unlatch the two (2) bow door container locks by rotating the handles one quarter (¼) turn.
6. Verify bow door is ready for opening by;
   A. Checking that all areas around the bow ramp and door are clear of all obstructions and all persons not involved.
   B. Checking that the main deck hydraulic control valves are in the middle position and the Float Safety Plate is in the down and locked position.
7. Start the bow ramp hydraulic power units (380) by pressing and releasing the BLACK buttons (362, 372) on the control panels.
8. After receiving the all clear from the main deck crew and the 2nd deck crew slowly raise the bow door by depressing the UP (open) button (392) on the 2nd deck control stand.
9. While raising the door all crew are to;
   A. Observe all areas for safe operations and stop raising if any issue arises.
   B. In any emergency the main deck crew can stop the bow door by turning off the hydraulic power units by depressing the two (2) RED buttons (364, 374) on the control panels 360, 370).
10. Raise the door until both safety bars drop into their safety catches. Verify BOTH safety bars are fully down and into the catches.
11. Stop the bow ramp hydraulic power units by pressing and releasing the RED buttons (364, 374) on the control panels.

C. Extending Bow Ramp Instructions

1. Check that all crew members are assembled, wearing work life vests, and are fully trained and briefed on their duties. Improper operation of the bow ramp can damage the vessel and/or cause severe injury or death.
2. Station three (3) crew members on the main deck forward and one (1) crew member on the 2nd deck forward with radios.
3. Check that all passengers and other persons not involved with the ramp deployment are clear of the ramp and the bow doors.
4. Verify ramp is ready for extending by;
   A. Checking that all areas around the bow ramp and door are clear of all obstructions and all persons not involved.
   B. Checking that the bow door is fully raised and the safety bars are in their deck notches.
   C. Checking that the golf cart is securely strapped at the inboard end of the ramp.
   D. Checking that the golf cart charging cord is unhooked.
   E. Checking that the main deck hydraulic control valves are in the middle position and the Float Safety Plate is in the down and locked position.
5. Start the bow ramp hydraulic power units (380) by pressing and releasing the BLACK buttons (362,372) on the control panels 360, 370).
6. After receiving the all clear from the main deck crew and the 2nd deck crew slowly extend the bow ramp by gently lifting the EXTEND lever (386) on the main deck control stand.
7. While extending the bow ramp all crew are to;
   A. Observe all areas for safe operations and stop extending the ramp if any issue arises.
   B. In any emergency the main deck crew can stop the bow ramp by turning off the hydraulic power units by depressing the two (2) RED buttons (364, 374) on the control panels.
8. After the bow ramp is fully extended slowly swing the ramp left or right and up or down as needed by gently using the swing and raise/lower levers (384, 388) on the main deck control stand. DO NOT swing the ramp left/right or raise/lower the ramp unless it is fully extended.
9. Stop the bow ramp hydraulic power units by pressing and releasing the RED buttons (364, 374) on the control panels.
10. After the bow ramp has been landed securely ashore and the bow ramp hydraulic power units have been turned off, lift the Float Safety Plate and push all three control levers into their fully up (float) position. The control levers are correctly set when they remain in the fully up (float) position.

D. Retracting Bow Ramp Instructions

1. Check that all crew members are assembled, wearing work life vests, and are fully trained and briefed on their duties. Improper operation of the bow ramp can damage the vessel and/or cause severe injury or death.
2. Station three (3) crew members on the main deck forward and one (1) crew member on the 2nd deck forward with radios.
3. Check that all passengers and other persons not involved with the ramp deployment are clear of the ramp and the bow doors.

4. Secure the golf cart (if carried) at the fully inboard position on the ramp.
5. Remove all inboard and outboard passenger access end ramps and boxes (170, 172) and any other obstructions.
6. Install the removable stowing rollers in the main deck.
7. Place the three (3) main deck hydraulic control valves in the middle position and the Float Safety Plate in the down and locked position.
8. Verify ramp is ready for retracting by;
   A. Checking that all areas around the bow ramp and door are clear of all obstructions and all persons not involved.
   B. Checking that the bow door is fully raised and the safety bars are in their deck notches.
   C. Checking that the golf cart is securely strapped at the inboard end of the ramp.
   D. Checking that the main deck hydraulic control valves are in the middle position and the Float Safety Plate is in the down and locked position.
9. Start the bow ramp hydraulic power units by pressing and releasing the BLACK buttons on the control panels.
10. Slowly raised the ramp into an approximately horizontal position.
11. Slowly swing the ramp into the approximate retract angle into the vessel.
12. After receiving the all clear from the main deck crew and the 2nd deck crew slowly retract the bow ramp by gently pushing down the RETRACT lever on the main deck control stand
13. As the ramp is being retracted, constantly observe its inboard end and if needed stop retraction of the ramp to adjust the up/down and swing position of the inboard ramp end to line up the ramp on the stowing rollers. Do Not attempt to adjust the ramp's up/down or left/right position while the ramp is being retracting.
15. Stop the bow ramp hydraulic power units by pressing and releasing the RED buttons on the control panels.

E. Closing Bow Door Instructions

1. Check that all crew members are assembled, wearing work life vests, and are fully trained and briefed on their duties. Improper operation of the bow door can damage the vessel and/or cause severe injury or death.
2. Station two (2) crew members on the main deck forward and two (2) crew members on the 2nd deck forward with radios.
3. Check that all passengers and other persons not involved with the bow opening are clear of the ramp and the bow doors.
4. Check that all areas around the bow ramp and door are clear of all obstructions.
5. Check that the bow ramp is fully retracted and secured.
6. Verify bow door is ready for closing by;
   A. Checking all areas around the bow ramp and door are clear of all obstructions and all persons not involved.
   B. Checking the two (2) bow door container locks are in the unlocked position.
   C. Checking the bow ramp is in the fully retracted position.
   D. Checking that the main deck hydraulic control valves are in the middle position and the Float Safety Plate is in the down and locked position.
7. Start the bow ramp hydraulic power units by pressing and releasing the BLACK buttons on the control panels.
8. After receiving the all clear from the main deck crew and the 2nd deck crew slowly raise the bow door by depressing the UP button on the 2nd deck control stand to the fully raised position and the safety bars are clear of the safety catches.
10. Lift the safety bays and flip the release bars over the safety catches.
11. After receiving the all clear from the main deck crew and the 2nd deck crew slowly lower the bow door by depressing the DN button on the 2nd deck control stand.
12. While closing the door all crew are to;
   A. Observe all areas for safe operations and stop closing if any issue arises.
   B. In any emergency the main deck crew can stop the bow ramp by turning off the hydraulic power units by depressing the two (2) RED buttons on the control panels.
13. Close the bow door until both bow door container locks are fully engaged.
14. Stop the bow ramp hydraulic power units by pressing and releasing the RED buttons on the control panels.
15. Latch the two (2) bow door container locks by rotating handle one quarter (¼) turn.

Having described preferred embodiments of a new and improved passenger vessel have a unique and novel extendable, steerable, retractable, and concealable bow gangway and the unique method for deploying, positioning, retracting and concealing the gangway, it is believed that other modifications, variations and changes will be suggested to those skilled in the art in view of the teachings set forth herein. It is therefore to be understood that all such variations, modifications and changes are believed to fall within the scope of the present invention.

What is claimed is:

1. A passenger vessel configured to either (a) moor along an unimproved shoreline and transfer passengers, crew, stores and other items between the ship and the shore or (b) be used at an improved dock side facility where it is desired to load or unload the vessel via the bow, comprising:

(a) a passenger vessel hull having a forward section including a bow opposing a stern separated by a hull length defined along a hull centerline plane, where said hull includes a port side hull segment and a starboard side hull segment which each define a hull bottom, wherein each of said port hull segment and said starboard hull segment are joined to a planar upper deck, wherein said port hull segment, said starboard hull segment and said upper deck define an enclosed hull interior volume therebetween;

(b) said vessel hull including a planar intermediate deck defined within said hull interior volume between said upper deck and said hull bottom, said intermediate deck having a forward edge;

(c) said vessel hull further including a movable bow member in said forward section configured to be moved between a closed state and an open state which exposes said hull interior volume and said intermediate deck surface;

(d) an extendable and steerable ramp or gang-plank assembly secured within said hull interior between said intermediate deck surface and said upper deck, said ramp or gang-plank assembly including an elongated extendable ramp member having a ramp distal end opposite a ramp proximal end and including a mounting member for said ramp, said assembly being configured to enable said ramp and said mounting member to be stowed in a storage location within said hull interior volume with said ramp distal end proximate said bow when said bow member is in said closed state;

(e) wherein said mounting member for said ramp member comprises a mounting frame secured for rotational motion about a vertical axis between said upper and intermediate decks and wherein said ramp is mounted on said frame and is movable longitudinally with respect to said mounting frame for extension out of said bow opening when said bow member is in said open state and for retraction into said storage location to allow said bow member to move to its closed state;

(f) a support element pivotally mounted for motion about a horizontal axis on said mounting frame for supporting said ramp for longitudinal motion with respect to said frame to extend said elongate ramp member distal end forwardly or distally beyond said bow to provide a distally projecting ramp extension supported to pivot at its proximal end from said support element at the mounting frame;

(g) wherein said frame element is rotatable about said vertical axis and said support element is pivotable about its horizontal axis to steer the distal end of the extended ramp horizontally and vertically, respectively, the ramp being movable horizontally and laterally with respect to said vessel in an arc defined beyond said bow through a ramp steering arc angle to either the port or starboard side of the vessel, and being movable vertically through a ramp steering arc angle upwardly or downwardly from the level of the intermediate deck; and (h) wherein said ramp member's distal end is configured to be moved in said vertical arc downwardly from said mounting member to engage a shore without the necessity of moving the vessel to orient said ramp.

2. The passenger vessel of claim 1, wherein said extendable and steerable ramp or gang-plank assembly is configured to be operable to steer said elongate ramp member's distal end distally laterally in an arc defined beyond said bow through a ramp steering arc angle of up to 90 degrees from the vessel's centerline plane to either the port or starboard side of said vessel's hull.

3. The passenger vessel of claim 1, wherein said extendable and steerable ramp or gang-plank comprises a unitary or one-piece elongated extendable ramp or gang-plank member defining a single rigidly supported span from the ramp distal end to the ramp proximal end, wherein said ramp member is extended by being conveyed distally through said bow opening from said stowed position to said extended position.

4. The passenger vessel of claim 1, wherein said extendable and steerable ramp or gang-plank assembly comprises a multi-piece telescoping ramp assembly including at least first and second slidably engaged telescoping ramp members defining a multi-piece supported span from the telescoped ramp distal end to the opposing ramp proximal end, wherein said multi-piece telescoping ramp assembly is telescoped and extended by being conveyed distally along a ramp axis through said bow opening from said stowed position to said telescoped extended position.

5. The passenger vessel of claim 1, wherein said extendable and steerable ramp or gang-plank assembly is retractable in a configuration which is stowed proximate said port hull segment or said starboard hull segment.

6. The passenger vessel of claim 1, wherein said extendable and steerable ramp or gang-plank assembly is retractable in a configuration which is stowed in an alignment which is substantially aligned with said hull's centerline plane.

7. The passenger vessel of claim 1, wherein said extendable and steerable ramp or gang-plank assembly is secured to a mounting member mounted at a forward end of the intermediate deck within the movable bow member when the bow member is closed and is secured to the upper deck and to the intermediate deck for rotation.

8. The passenger vessel of claim 1, wherein said movable bow member is configured to be hingedly moved between a closed state and an open state which exposes said hull interior volume and said intermediate deck, said bow member being configured with a hinge mechanism affixed to and supported by said vessel hull's upper deck surface so that said bow member is movable between the closed state and said open state.

9. The passenger vessel of claim 8, wherein said movable bow member moves between said closed state and said open state by swinging or pivoting through an arc along a substantially transverse horizontal axis of movement, said bow member being a unitary structure pivotably connected to said hull's forward section, said unitary bow member including a first rear edge and second rear edge terminating at corresponding bottom edges, wherein said bottom edge meet at an acute interior angle at the prow of the vessel which aligns with a centerline plane of the hull when the moveable bow member is in said closed state.

10. A passenger vessel concealable gangplank assembly, comprising:

(a) an elongated extendable ramp or gang-plank member having a ramp distal end opposite a ramp proximal end and being configured with a steerable mount configured to be fastened within passenger vessel hull interior below a hull upper deck;

(b) said elongated extendable ramp or gang-plank member being configured to be stowed in a nondeployed state with said ramp distal end near a passenger hull's forward section and within an openable bow member in its closed state, wherein said ramp proximal end is configured to be in a stowed position adjacent a port hull segment or a starboard hull segment when said gang-plank member is in said nondeployed state, wherein said bow member is openable to an open state to provide a bow opening, and wherein said ramp member is extendable by being conveyed distally or forwardly through said bow opening from said stowed position to an extended position;

(c) said gangplank assembly further including a pivot or swing mount affixed within said hull interior volume to support said ramp, said extendable and steerable ramp or gang-plank assembly being operable to extend said elongate ramp member's distal end distally beyond said bow to define a deployed state in which a distally projecting ramp extension is supported from said ramp's proximal end;

(d) said gangplank assembly further including a drive mechanism for said extendable and steerable ramp or gang-plank assembly operable to steer said elongate ramp member's distal end vertically and laterally in arcs defined beyond said bow, including a lateral ramp steering arc angle to either the port or starboard side and a vertical ramp steering angle, wherein said ramp angles extend from a centerline plane and are controlled from said pivot or swing mount when said ramp member is extended and is in said deployed state; and wherein said ramp member's distal end is configured to be moved in said vertical arc downwardly from said steerable mount to engage a shore without the necessity of moving the vessel to orient said ramp.

11. The passenger vessel concealable gangplank assembly of claim 10, wherein said extendable and steerable ramp or gang-plank assembly includes a steering mechanism to steer said elongate ramp member's distal end laterally in an arc defined beyond said bow through a ramp steering arc angle of up to 90 degrees from the vessel's centerline plane to either the port or starboard side of said vessel's hull.

12. The passenger vessel concealable gangplank assembly of claim 10, wherein said extendable and steerable ramp or gang-plank assembly comprises a unitary or one-piece elongated extendable ramp or gang-plank member defining a single rigidly supported span from the ramp distal end to the ramp proximal end, wherein said ramp member is extended by being conveyed distally through a bow opening from said stowed position to said extended, deployed position.

13. The passenger vessel concealable gangplank assembly of claim 10, wherein said extendable and steerable ramp or gang-plank assembly comprises a two-piece telescoping ramp assembly including first and second slidably engaged telescoping ramp members defining a two-piece supported span from the telescoped ramp distal end to the opposing ramp proximal end, wherein said two-piece telescoping ramp assembly is telescoped and extended by being conveyed distally along a ramp axis through a bow opening from said stowed position to said telescoped extended deployed position.

14. The passenger vessel concealable gangplank assembly of claim 10, wherein:

said extendable and steerable ramp or gang-plank assembly pivot or swing mount affixed within said hull interior volume comprises a mounting frame to support said ramp, said mounting frame including a support structure which incorporates a bottom, or base cross-member spanning a lateral width of the frame support structure, port and starboard, or left and right parallel upright or vertical members or posts extending the height of the frame, and a top cross-member which spans the lateral width of the frame between the vertical members; and slide supports mounted inside said mounting frame on said vertical frame members, each said slide support being secured by a horizontal pivot axle to a corresponding frame member and centered on a horizontal pivot axis for pivotal motion with respect to the vertical frame member, said slide supports receiving and movably securing said ramp within and extending through said mounting frame to enable the ramp to slide forwardly and rearwardly through the frame for extension forwardly out of said hull and rearwardly into said hull for storage.

15. The passenger vessel concealable gangplank assembly of claim 14, wherein said extendable and steerable ramp or gang-plank assembly mounting frame further includes a drive mechanism connected between said mounting frame and at least one of said slide supports to pivot said ramp about said horizontal axis.

16. The passenger vessel concealable gangplank assembly of claim 15, wherein said extendable and steerable ramp or gang-plank assembly mounting frame is pivotably mounted between said upper and intermediate decks by vertically extending pivot pins mounted on said bottom and top crossmembers of said mounting frame.

17. A method for operating a passenger vessel when either (a) mooring along an unimproved shoreline and transferring passengers, crew, stores and other items between the ship and the shore or (b) loading or unloading the vessel via the bow, comprising the method steps of:

(a) providing a hull having a movable bow member configured to be moved between a closed state and an open state which exposes the hull's interior volume; and (b) mounting, within said hull interior volume, an extendable and steerable ramp or gang-plank assembly including an elongated retractable and extendable ramp or gang-plank member a steerable mount supporting;

(c) configuring said assembly to enable said ramp or gang-plank member to be retracted and stowed in the hull's interior when the bow member is in the closed state and extended out of the hull's interior when the bow member is in the open state; and (d) extending and then lowering said ramp or gang-plank member downwardly from said steerable mount to engage a shoreline or dock facility.

18. The method of claim 17 further including:

(a) mounting said ramp or gang-plank member on a rotatable and pivotal mounting frame within the bow of said vessel; and (b) locating said mounting frame to enable said ramp or gang-plank member to be retracted to a storage location within the hull with the ramp's or gang-plank member's proximal end in a stowed position proximate the hull's port side or starboard side or extended to a ramp or gang-plank member extension position forwardly out of the hull.

19. A method for operating a passenger vessel to embark or disembark passengers and crew or to load and unload stores or other items by way of a bow access opening when moored along either an improved or unimproved shoreline, comprising:

(a) providing a vessel having a hull with a movable bow member configured to be moved between a normal closed state and an open state which exposes an interior volume of the hull;

(b) providing an extendable and steerable ramp or gang-plank assembly including an elongated retractable and extendable ramp or gang-plank member;

(c) stowing said assembly in its retracted state within the said interior volume of the hull when the bow member is in the closed state;

(d) when retracted, locating a proximal end of the ramp in a stowage location on a vessel deck and locating a distal end of the ramp within the closed bow member;

(e) mooring the vessel adjacent an improved or unimproved shoreline;

(f) opening the bow member to expose the ramp assembly;

(g) extending the ramp through the bow opening forwardly of the hull; and (h) steering and lowering the distal end of the ramp to contact and rest on the adjacent shoreline.

20. The method of claim 19, further including before the vessel departs from the mooring:

(a) raising and steering the distal end of said ramp to remove it from contact with the adjacent shoreline;

(b) rotating the distal end of the ramp horizontally to a predetermined beginning position in alignment with its prior stowed location in the hull;

(c) pivoting the distal end of the ramp to raise or lower it vertically until the ramp is parallel to said deck;

(d) stowing the ramp within the hull by retracting the ramp into its stowage location; and (e) closing the bow member to conceal the ramp.

21. A passenger vessel concealable gangplank assembly, comprising:

(a) an elongated extendable ramp or gang-plank member having a ramp distal end opposite a ramp proximal end and being configured with a steerable mount configured to be fastened within passenger vessel hull interior below a hull upper deck;

(b) said elongated extendable ramp or gang-plank member being configured to be stowed in a nondeployed state with said ramp distal end near a passenger hull's forward section and within an openable bow member in its closed state, wherein said ramp proximal end is configured to be in a stowed position adjacent a port hull segment or a starboard hull segment when said gang-plank member is in said nondeployed state, wherein said bow member is openable to an open state to provide a bow opening, and wherein said ramp member is extendable by being conveyed distally or forwardly through said bow opening from said stowed position to an extended position;

(c) said gangplank assembly further including a pivot or swing mount affixed within said hull interior volume to support said ramp, said extendable and steerable ramp or gang-plank assembly being operable to extend said elongate ramp member's distal end distally beyond said bow to define a deployed state in which a distally projecting ramp extension is supported from said ramp's proximal end;

(d) said gangplank assembly further including a drive mechanism for said extendable and steerable ramp or gang-plank assembly operable to steer said elongate ramp member's distal end vertically and laterally in arcs defined beyond said bow, including a lateral ramp steering arc angle to either the port or starboard side and a vertical ramp steering angle, wherein said ramp angles extend from a centerline plane and are controlled from said pivot or swing mount when said ramp member is extended and is in said deployed state; and wherein said extendable and steerable ramp or gang-plank assembly pivot or swing mount affixed within said hull interior volume comprises a mounting frame to support said ramp, said mounting frame including a support structure which incorporates a bottom, or base cross-member spanning a lateral width of the frame support structure, port and starboard, or left and right parallel upright or vertical members or posts extending the height of the frame, and a top cross-member which spans the lateral width of the frame between the vertical members; and slide supports mounted inside said mounting frame on said vertical frame members, each said slide support being secured by a horizontal pivot axle to a corresponding frame member and centered on a horizontal pivot axis for pivotal motion with respect to the vertical frame member, said slide supports receiving and movably securing said ramp within and extending through said mounting frame to enable the ramp to slide forwardly and rearwardly through the frame for extension forwardly out of said hull and rearwardly into said hull for storage.

22. The passenger vessel concealable gangplank assembly of claim 21, wherein said extendable and steerable ramp or gang-plank assembly mounting frame further includes a drive mechanism connected between said mounting frame and at least one of said slide supports to pivot said ramp about said horizontal axis.

23. The passenger vessel concealable gangplank assembly of claim 22, wherein said extendable and steerable ramp or gang-plank assembly mounting frame is pivotably mounted between said upper and intermediate decks by vertically extending pivot pins mounted on said bottom and top crossmembers of said mounting frame.

* * * * *